US007677543B2

(12) United States Patent
Gulbrandsen et al.

(10) Patent No.: US 7,677,543 B2
(45) Date of Patent: Mar. 16, 2010

(54) SHEET HANDLING APPARATUS

(76) Inventors: Terje Gulbrandsen, 12500 Triadelphia Rd., Ellicott City, MD (US) 21042; Roye Weeks, 6241 Lakeview Dr., Falls Church, VA (US) 22041

( * ) Notice: Subject to any disclaimer, the term of this patent is extended or adjusted under 35 U.S.C. 154(b) by 0 days.

(21) Appl. No.: 11/157,399

(22) Filed: Jun. 20, 2005

(65) Prior Publication Data

US 2005/0285323 A1 Dec. 29, 2005

Related U.S. Application Data

(60) Provisional application No. 60/580,380, filed on Jun. 18, 2004.

(51) Int. Cl.
*B65G 47/00* (2006.01)
*B65G 47/34* (2006.01)

(52) U.S. Cl. ..... 270/52.22; 270/52.14; 270/52.16; 198/418.1; 198/418.2

(58) Field of Classification Search ..... 270/52.14, 270/52.16, 52.19, 52.2, 52.22; 198/418.1, 198/418.2
See application file for complete search history.

(56) References Cited

U.S. PATENT DOCUMENTS

| | | | | |
|---|---|---|---|---|
| 3,245,679 | A | 4/1966 | Mueller | |
| 3,522,942 | A * | 8/1970 | Hepp | 270/52.14 |
| 3,658,318 | A * | 4/1972 | Bunting et al. | 270/52.29 |
| 4,037,525 | A | 7/1977 | Sjogren et al. | 93/93 C |
| 4,054,380 | A * | 10/1977 | Donohue et al. | 700/27 |
| 4,068,946 | A | 1/1978 | Eschweiler, Jr. et al. | 355/64 |
| 4,145,037 | A | 3/1979 | Mol | 270/58 |
| 4,145,038 | A | 3/1979 | Mol | 270/58 |
| 4,146,215 | A | 3/1979 | Mol | 270/58 |
| 4,146,216 | A | 3/1979 | Brown | 270/58 |
| 4,219,192 | A | 8/1980 | Burke | 271/160 |
| 4,354,672 | A | 10/1982 | Kulpa et al. | 271/221 |
| 4,452,440 | A | 6/1984 | Fagan et al. | 271/3.1 |
| 4,548,395 | A | 10/1985 | Snellman et al. | 271/11 |
| 4,562,339 | A | 12/1985 | Sjogren et al. | 235/98 R |
| 4,602,775 | A | 7/1986 | Calhoun et al. | 270/55 |
| 4,645,069 | A | 2/1987 | Sjogren | 198/689.1 |
| 4,678,387 | A | 7/1987 | Sjogren et al. | 414/47 |

(Continued)

FOREIGN PATENT DOCUMENTS

DE 19829484 11/1999

(Continued)

OTHER PUBLICATIONS

Kipphan, Helmut; "Handbook of Print Media", 2001, pp. 816-825.

*Primary Examiner*—Gene Crawford
*Assistant Examiner*—Leslie A Nicholson, III
(74) *Attorney, Agent, or Firm*—Perman & Green, LLP

(57) ABSTRACT

A sheet handling apparatus is provided for collating or inserting inserts. The sheet handling apparatus has a raceway adapted to transport sets of inserts at a raceway transport rate. An insert feed line is provided adapted to feed individual inserts to the sets of inserts on the raceway at the raceway transport rate. The insert feed line has a Singulater adapted to separate the individual inserts from bundles of inserts at a separation rate. The separation rate may be varied to allow the insert feed line to feed the individual inserts to the sets of inserts on the raceway at the raceway transport rate.

3 Claims, 16 Drawing Sheets

U.S. PATENT DOCUMENTS

| | | | | | |
|---|---|---|---|---|---|
| 4,720,960 | A | | 1/1988 | Green | 53/447 |
| 4,723,770 | A | | 2/1988 | Seidel et al. | 270/55 |
| 4,746,007 | A | | 5/1988 | Houseman | 198/470.1 |
| 4,768,770 | A | | 9/1988 | Pessina et al. | 271/107 |
| 4,812,099 | A | | 3/1989 | Sjogren et al. | 414/788.2 |
| 4,852,722 | A | | 8/1989 | Houseman | 198/803.7 |
| 4,905,818 | A | | 3/1990 | Houseman | 198/803.7 |
| 5,014,975 | A | | 5/1991 | Hamricke | 271/202 |
| 5,026,038 | A | | 6/1991 | Weller et al. | 271/3.1 |
| 5,054,601 | A | | 10/1991 | Sjogren et al. | 198/365 |
| 5,054,993 | A | | 10/1991 | Watts et al. | 414/790.5 |
| 5,088,711 | A | * | 2/1992 | Newsome | 270/52.14 |
| 5,092,236 | A | | 3/1992 | Prim et al. | 100/220 |
| 5,103,617 | A | | 4/1992 | Sjogren et al. | 53/399 |
| 5,135,102 | A | | 8/1992 | Sjogren et al. | 198/468.6 |
| 5,165,672 | A | | 11/1992 | Backman | 270/55 |
| 5,171,005 | A | | 12/1992 | Manley et al. | 270/1.1 |
| 5,207,412 | A | * | 5/1993 | Coons et al. | 270/1.02 |
| 5,226,780 | A | | 7/1993 | Sjogren et al. | 414/790.4 |
| 5,265,858 | A | | 11/1993 | Hobbs et al. | 271/11 |
| 5,269,504 | A | | 12/1993 | Backman | 270/55 |
| 5,274,983 | A | | 1/1994 | Sjogren et al. | 53/399 |
| 5,282,716 | A | | 2/1994 | Prim et al. | 414/790.3 |
| 5,326,093 | A | | 7/1994 | Sollitt | 271/306 |
| 5,360,101 | A | | 11/1994 | Carlen | 198/803.7 |
| 5,575,379 | A | | 11/1996 | Schmetzer | 198/803.9 |
| 5,581,354 | A | | 12/1996 | Hassbjer | 356/381 |
| RE35,555 | E | | 7/1997 | Sjogren et al. | 414/331 |
| 5,673,907 | A | * | 10/1997 | Rumsey et al. | 271/9.13 |
| 5,772,391 | A | | 6/1998 | Sjogren et al. | 414/790.9 |
| 5,921,546 | A | | 7/1999 | Herman | 271/270 |
| 5,944,304 | A | | 8/1999 | Branecky et al. | 271/2 |
| 6,007,064 | A | | 12/1999 | Cote et al. | 271/279 |
| 6,082,724 | A | * | 7/2000 | Kahlig et al. | 270/52.14 |
| 6,092,801 | A | | 7/2000 | Abbadessa et al. | 271/204 |
| 6,135,441 | A | * | 10/2000 | Belec et al. | 271/35 |
| 6,176,483 | B1 | | 1/2001 | Malevanchik | 271/270 |
| 6,257,566 | B1 | | 7/2001 | Dooley | 270/52.18 |
| 6,341,775 | B1 | | 1/2002 | Matz, IV | 271/186 |
| 6,386,537 | B1 | | 5/2002 | Howard et al. | 271/303 |
| 6,547,231 | B1 | | 4/2003 | Chick | 270/58.29 |
| 6,598,872 | B1 | | 7/2003 | Gunschera et al. | 271/197 |
| 6,623,000 | B2 | | 9/2003 | Hall | 271/11 |
| 6,651,558 | B2 | * | 11/2003 | Benson | 101/233 |
| 6,698,749 | B2 | | 3/2004 | Muller | 271/99 |
| 6,719,123 | B2 | | 4/2004 | Jackson et al. | 198/626.1 |
| 6,742,778 | B2 | | 6/2004 | Ferus | 271/3.01 |
| 6,748,294 | B1 | | 6/2004 | Overman et al. | 700/224 |
| 6,789,793 | B2 | | 9/2004 | Caunter et al. | 271/175 |
| 6,851,669 | B2 | | 2/2005 | Kelm | 271/34 |
| 2003/0184006 | A1 | | 10/2003 | Ferus | 271/145 |
| 2004/0186616 | A1 | | 9/2004 | Overman et al. | 700/224 |
| 2004/0195073 | A1 | * | 10/2004 | Prakken | 198/418.1 |
| 2004/0245716 | A1 | | 12/2004 | Bates et al. | 271/276 |
| 2005/0040322 | A1 | | 2/2005 | Sjogren | 250/223 |

FOREIGN PATENT DOCUMENTS

| | | |
|---|---|---|
| EP | 0 417 869 | 3/1991 |
| EP | 0 727 379 | 2/1996 |
| EP | 1 108 668 | 6/2001 |
| EP | 1 524 126 | 4/2005 |

* cited by examiner

SHEET HANDLING APPARATUS

CROSS-REFERENCE TO RELATED APPLICATION(S)

This application claims the benefit of U.S. Provisional Application No. 60/580,380, filed Jun. 18, 2004 which is incorporated by reference herein in its entirety.

BACKGROUND OF THE INVENTION

1. Field of the Invention

The present invention relates to a sheet handling apparatus and, more particularly, to a sheet handling apparatus for handling free standing inserts. A free standing insert can be a single sheet of paper, two tab pages, or it can be many sheets bound together or encased in a plastic or paper bag.

2. Brief Description of Related Developments

In the newspaper industry, post-press inserting and collating equipment are used for assembling products such as advertising and promotional materials to customers. Book and magazine manufactures also use inserting and collating for assembling books, magazines, and marriage mail products. Other manufactures use inserting and collating equipment for assembling products such as advertising and promotional materials to postal customers. Now inserts volumes are increasing and advertisers want to target their inserts to specific customers. Consequently, equipment capacity and physical mailroom space are often insufficient, and labor costs are rising for equipment maintenance. Currently, such industries use hoppers to move free standing inserts and signatures (collectively referred to in this disclosure as "FSI") to their proper package. FSI are stacked above a hopper, from which the FSI are pulled from the bottom of a stack by a vacuum and gripper device and fed onto on a raceway at capacity raceway speed. The FSI proceed to raceway speed within microseconds. During the travel of the FSI, they are measured for thickness and presence. A problem arises if an error is detected as there is no way to correct the problem. Existing technology dates back to hoppers that were introduced in the 1940's. As raceway speed has been increased in response to industry demands, hopper-related equipment has increased dramatically in weight and vibration. Existing equipment to move single-sheet FSI may weight 500 pounds. The weight and thus inertia of such apparatus prevents quick stops and starts for allowing corrections when misfeeds occur. Furthermore, existing equipment continues the feeding operation and conveyance of FSI to their destination, despite having detected faults such as blanks and multiple sheets, resulting in defective products. An alarm is provided indicating defective operation, but not a solution. Thus, bundles with mistaken inserts must be separated and corrected at considerable time and expense, or worse, delivered with defects to customers. There is currently a demand to package inserted and collated materials together but the packages are too large to run in conventional hoppers. A great deal of expense is incurred by newspapers to assemble the large packages by hand. This process is commonly referred to as Big-into-Big.

SUMMARY OF THE INVENTION

In a first exemplary embodiment, a sheet handling apparatus is provided for collating or inserting inserts. The sheet handling apparatus has a raceway adapted to transport sets of inserts at a raceway transport rate. An insert feed line is provided adapted to feed individual inserts to the sets of inserts on the raceway at the raceway transport rate. The insert feed line has a Singulater adapted to separate the individual inserts from bundles of inserts at a separation rate. The separation rate may be varied to allow the insert feed line to feed the individual inserts to the sets of inserts on the raceway at the raceway transport rate.

In another exemplary embodiment, a sheet handling apparatus for collating or inserting inserts is provided. The apparatus has first and second raceways adapted to transport sets of inserts along first and second transport paths, the first and second transport paths being substantially parallel to each other. The first and second raceways having first and second independent insert insertion points. Each independent insertion point having an insert feed line. Each insert feed line having a Singulater adapted to separate the individual inserts from bundles of inserts at a separation rate. The separation rate of each insert feed line may be varied to allow each insert feed line to feed individual inserts to the sets of inserts on the raceway.

In another exemplary embodiment, a modular raceway is provided for transporting sets of accumulated inserts. The modular raceway has a raceway conveyor section adapted to convey the sets of accumulated inserts; and an insert feed line section adapted to feed individual inserts to the sets of accumulated inserts on the raceway conveyor. The modular raceway is adapted to be extended by adding additional raceway conveyor sections to the raceway conveyor, the additional raceway conveyor sections having additional insert feed line sections, and wherein, the modular raceway is adapted to be extended to support where the type or quantity of individual inserts in a given set of accumulated inserts changes.

In another exemplary embodiment, an insert feed line for loading individual inserts on a raceway is provided. The insert feed line has a bundle feeder adapted to feed bundles of inserts to a Singulater; the Singulater adapted to separate individual inserts from the bundles of inserts at a separation rate; and an insert feeder interfacing with the Singulater, the insert feeder adapted to accept the individual inserts from the Singulater and feed the individual inserts to the raceway at a transport rate. The separation rate is variable and selectable to be different than the transport rate.

In another exemplary embodiment, an insert feed line for loading individual inserts on a raceway is provided. The insert feed line has a Singulater adapted to separate individual inserts from a bundle of inserts; and a metering conveyor having a vacuum belt, the metering conveyor interfacing with the Singulater, the metering conveyor adapted to transport the individual inserts from the Singulater and feed the individual inserts to the raceway. The bundle of inserts may comprise either compensated or uncompensated stacks.

In another exemplary embodiment, an insert feed line for loading individual inserts on a raceway is provided. The insert feed line has a Singulater feed elevator adapted to feed bundles of inserts to a Singulater. The Singulater is adapted to separate individual inserts from bundles of inserts. A metering conveyor is provided interfacing with the Singulater, the metering conveyor adapted to transport the individual inserts from the Singulater and feed the individual inserts to the raceway. The Singulater feed elevator has a first lift adapted to lift and interface a first bundle of inserts to the Singulater; a second lift independently movable and operable from the first lift, the second lift adapted to lift and interface a second bundle of inserts to the Singulater first bundle of inserts. The second bundle interfaces with the Singulater when the first bundle has been depleted by the Singulater, and wherein a substantially continuous supply of singulated inserts are provided to the metering conveyor and the raceway.

BRIEF DESCRIPTION OF THE DRAWINGS

The foregoing aspects and other features of the present invention are explained in the following description, taken in connection with the accompanying drawings, wherein.

DETAILED DESCRIPTION OF THE EMBODIMENT(s)

Figure 1:
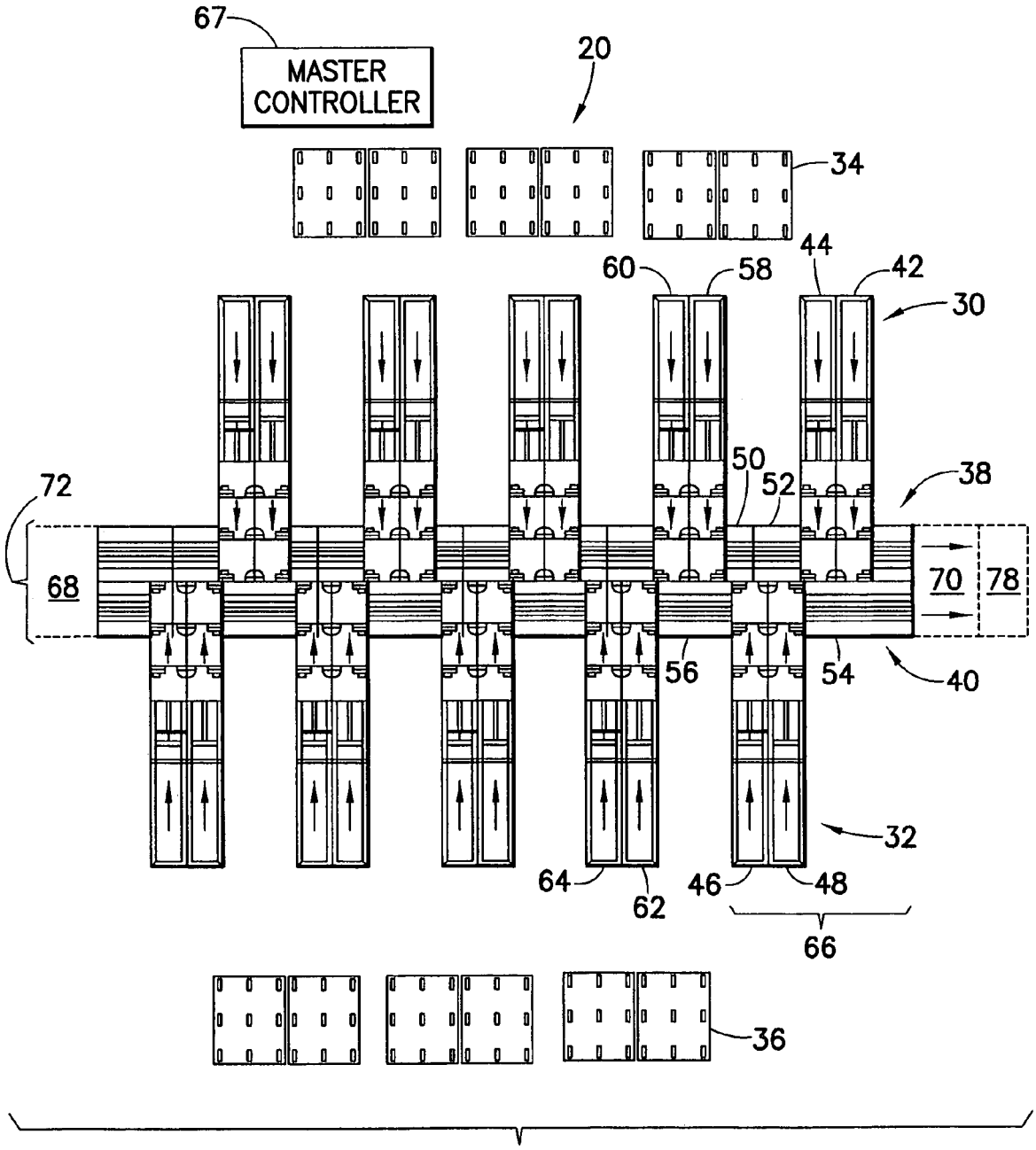
FIG. 1 is a plan view of a sheet handling apparatus.
Figure 2:
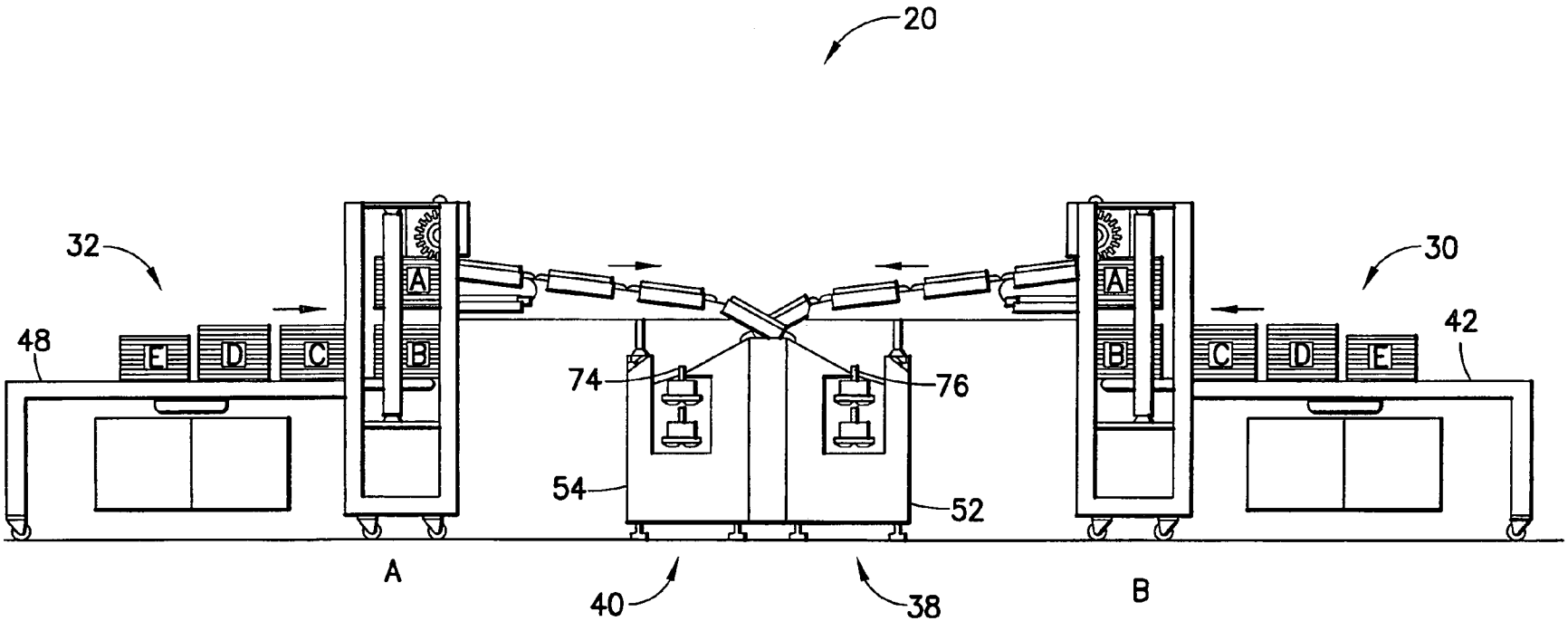
FIG. 2 is an elevation view of the sheet handling apparatus in FIG. 1.

Referring now to FIG. 1, there is shown a plan view of a sheet handling apparatus 20. Referring also to FIG. 2, there is shown a section view of the sheet handling apparatus of FIG. 1. Although the present invention will be described with reference to the embodiments shown in the drawings, it should be understood that the present invention can be embodied in many alternate forms of embodiments. In addition, any suitable size, shape or type of elements or materials could be used. The sheet handling apparatus 20 could be adapted to run on any type of raceway or inserting machine provided a proper interface is designed and fitted. The sheet handling apparatus 20 is controlled by a master supervisory controller 67. The individual modules of apparatus 20 may have individual controllers as required.

The sheet handling apparatus 20 generally has a series of singulating feed lines 30, 32 that feed stacks of free standing inserts (FSI) into an inserting and/or collation system 38, 40. The inserter and/or collating raceway 38, 40 is fed by the inserter collation system may have multiple raceway paths with each raceway defining an independent insertion and/or collation path independently fed by corresponding inserter and collation systems. For example, four raceway box sections 50, 52, 54, 56 may correspond to eight Singulater s 42, 44, 46, 48, 58, 60, 62, 64. The inserter and/or collator raceway is modular where the raceway modules may be selectably arranged in relation to a predetermined characteristic of the inserts being inserted and/or collated on the raceway; for example, the characteristic being the number of inserts. The Singulater functions with both inserting and collating. Collating involves deposition and/or laying on top and may involve individual sheets or multiple sheets, for example, 20 sheets at a time. Inserting involves dropping signature(s) and/or inserts and/or FSI (free standing insert) into a folded jacket. A jacket may be an insert that is folded and passed in front of each sheet handling apparatus for the purpose of receiving FSIs into the jacket.

The collector, raceway, gather section 72 has dual sections with parallel running conveyors 38, 40, a jacket opener 68, multiple (in the embodiment shown for example four (4)) feeder sections 66, angle positioned conveyors 52, 54 with pocket conveying pins and a merge section 70. These components facilitate the transporting of the individually inserted products to the merge section 70. The dual section conveyor 38, 40 enables the gathering of products onto two separate collections simultaneously and independently. The jacket opener 68 separates the two ends in a folded product or newspaper allowing the inserted products to be stored in the pocket that is created and enables the system to initiate a new collection of products anywhere in the raceway, gather section 72. Here, throughput is optimized while keeping singulation speed of the feed lines to a minimum. The raceway 50, 52, 54, 56, is divided into four feeder sections for maximizing the flexibility of configuring the usage of the singulation machines where additional sections may be provided depending upon insert capacity required. Angled conveyors 38, 40 reduce the complexity of feeding products perpendicular to the direction of travel. Pins 74, 76 provide compartments for the product to be inserted into as well as helping the transfer of products from one raceway section 50, 56 to the next 52, 54 for example. The merge section 70 facilitates the blending of the products from each side of the raceway gather section into a pile of two complete products. The merge section 70 may also be used to separate the completed products allowing each completed product to be inserted into a plastic bag. The piling section 78 has a mechanical stacker that collects a certain quantity of completed products into bundles at the end of the raceway, gather section. A bagger may insert each completed assembled product into its own plastic bag. This task may be performed prior to collecting these bagged FSIs into bundles. The function may be performed when the individual FSIs are gathered in a collated format rather than in an inserted format.

Figure 3A:
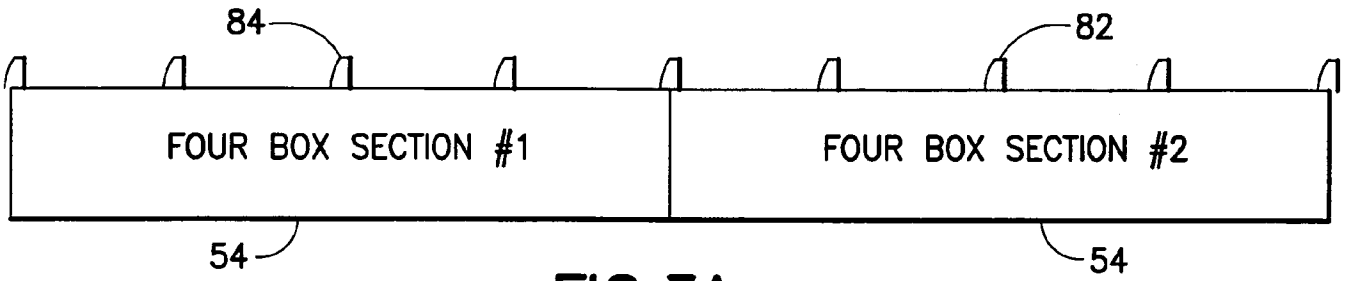
FIG. 3A is an elevation view of a raceway of the sheet handling apparatus.
Figure 3C:
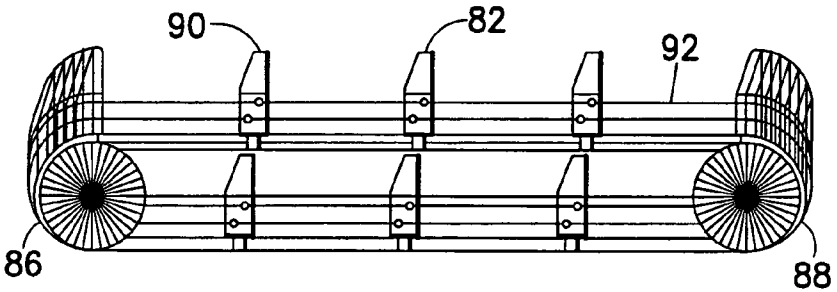
FIG. 3C is an elevation view of the raceway drive.
Figure 3B:
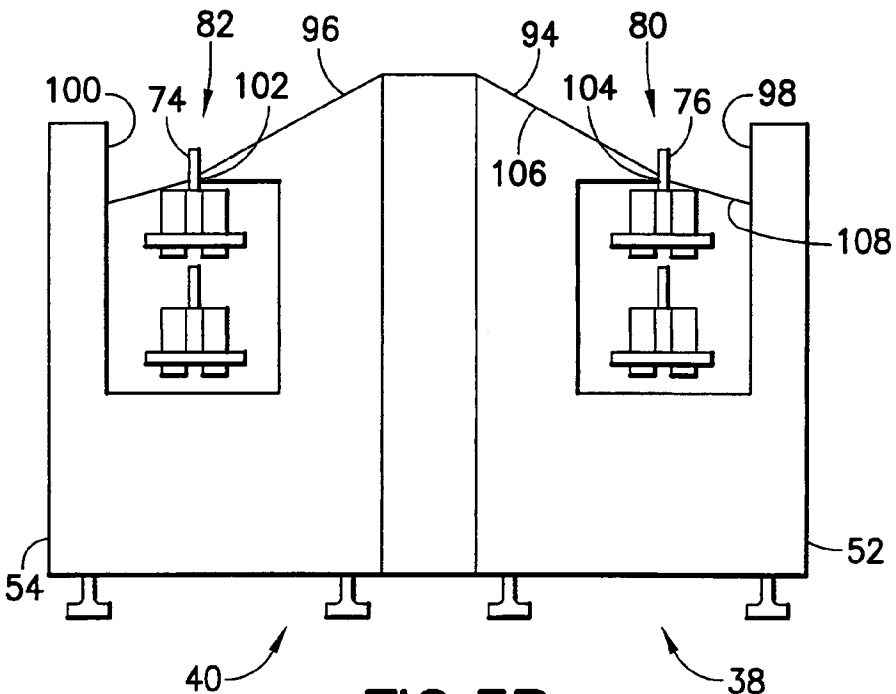
FIG. 3B is an elevation view of the raceway.

Referring now FIG. 3A, there is shown an elevation view of a raceway showing two adjoining raceway box sections, raceway box section one 56 and raceway box section two 54. Referring also to FIG. 3B, there is shown a elevation view of a raceway 38, 40. The end view shows an angled portion 94, 96 that is sloped with side stops 98, 100. The sloped area may be sheet metal or alternately rollers or conveyor. A slot 102, 104 is provided for pins 74, 76 of raceway drives 80, 82 to travel therein substantially the full length of the raceway. To prevent inserts from falling into the slot, the sloped portion 94 may be provided with two sections 106, 108 having differing slopes or where the surfaces of the slopes are offset one from the other. With the difference in slope or offset, the initial insert will not be obstructed or go into the slot. Referring also to FIG. 3C, there is shown a elevation view of a raceway drive 82. In this embodiment, the raceway drive may have a link and chain mechanism 92 that is driven by drives 86, 88 that may comprise, for example, servo motors and sprockets. The chain mechanism 92 has two sets of driven chain members that cooperate to keep pins 90 in a vertical orientation over the traveling range of the raceway section. As seen in FIG. 3A, a single drive 82 corresponds to raceway section 54 and separate single drive 84 corresponds to raceway section 56. Here, the drives are synchronized and staggered to keep continuous contact with the sheets being fed across the multiple raceway sections. As an example, a drive section may operate in the range of 200 pins per minute with a 20 inch pin pitch. In alternate embodiments, other suitable speeds or pitches may be used. The drive and raceway sections in this manner are modular in fashion where a user may add or remove sections depending upon the desired insert capacity, for example.

Figure 4:
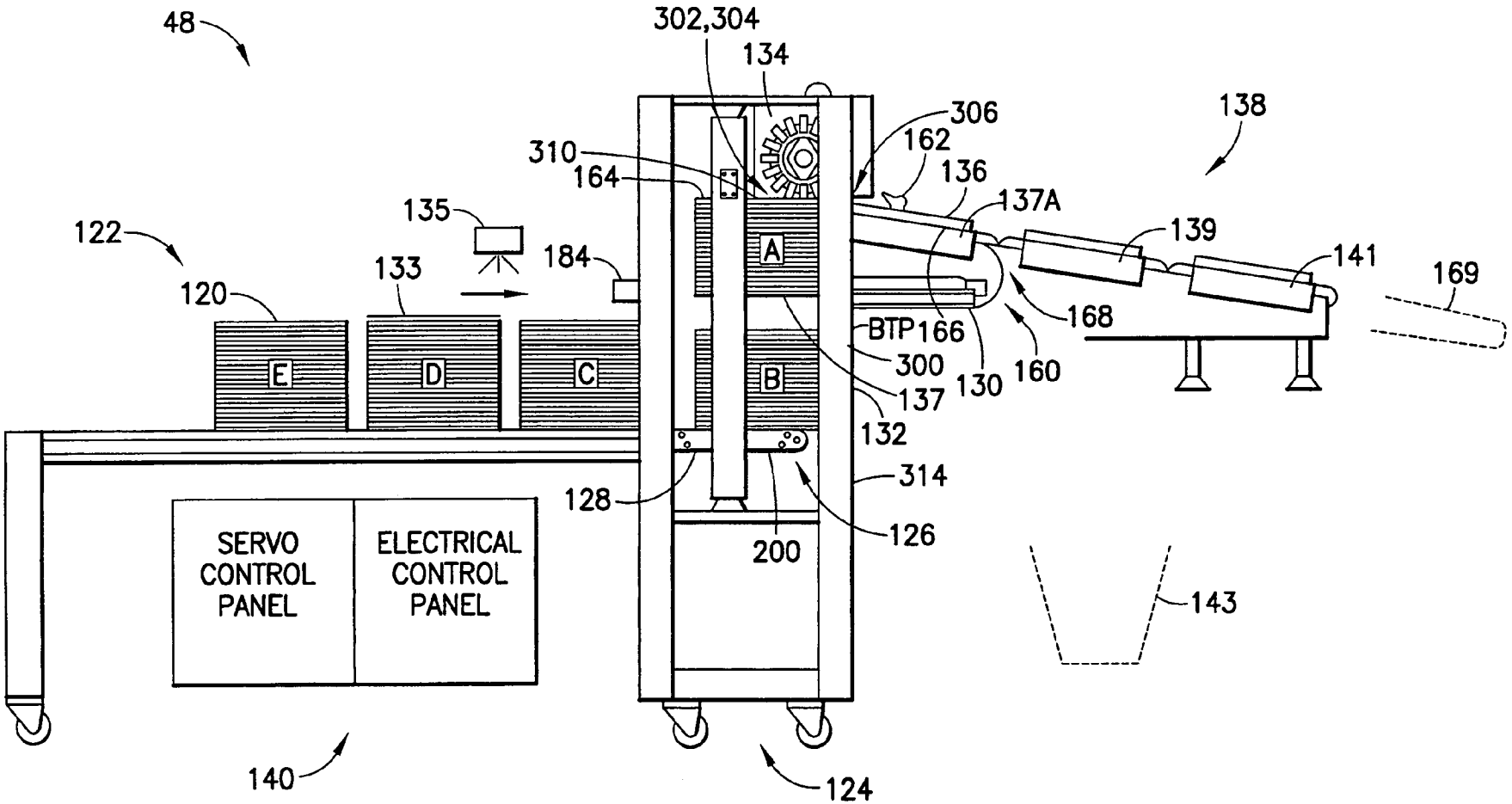
FIG. 4 is an elevation view of a Singulater feed line of the sheet handling apparatus.

Referring now to FIG. 4, there is shown an elevation view of a first embodiment Singulater feed line sheet handling apparatus 48. The sheet handling apparatus generally comprises an input system 122, a singulation device 134, an output system 138 and a control system 140. The Singulater feed lines enable continuous feeding of Free Standing Insert (FSI) bundles from bins, skids, and pallets 34, 36 without interrupting sheet dispensing or ejection. Generally, the singulating feed lines feed and lift of discrete bundles on a conveyer 122 to effectively provide an endless supply of feed stacks to a feed magazine for dispensing. Input conveyor 122 receives untied stacks of FSI bundles, for example, horizontally stacked FSI. In FIG. 4, generally, work flows from left to right. The input system 122 is generally a handling system for feeding insert stacks 120 made up of multiple free standing inserts (FSI) into the inserter and collation system 48. An elevation and positioning system or continuous replenishment magazine 132 is located between the input handling system 122 and the singulation device 134. The system 132 has an elevator conveyor 126 and elevator bayonets 130. The elevation and positioning system 132 communicates with the input handling system 122 to receive input stacks 120, and positions the stacks to supply the singulation system with a continuous stream of inserts. The elevation system 132 may have a first lift device 300, such as on elevator bayonets 130 capable of lifting initial feed stacks from the input handling system 122 to the singulation device 134. The elevation system 132 may also have a second lift device 128, such as on elevator conveyors 126 for feeding replenishment stacks and maintaining substantially continuous insert feed to the singulation device 134. At least one of the first or second lifting devices 300, 128 is capable of movement, other than vertical, allowing for passing off or transfer of feed stacks between lifting devices 300 and 128. At least one of the lifting devices 300, 128 has the ability to level, horizontally, the top of the stack 164. A metering section 138 is provided for receiving singulated inserts 166 from the singulation device 134. The metering section has a handling system for moving singulated free standing inserts from the singulation device. The metering section 138 has sensors 162 for detecting sheet features, such as presence or thickness for example, to facilitate detecting multiple feeds or mis-feeds and for sensing the free standing insert thickness. The metering section may have a reject gate 168 for rejecting mis-feeds and may further have a buffer (no shown) or function as a buffer. The metering section 138 is provided to link and synchronize free standing inserts fed by the metering section 138 with the inserter rate and meter the inserts to the output section 169. The Output Section 169 outputs single free standing inserts to the inserter and/or collating raceway. The output section 169 may include an inductor device located downstream of the metering section that handles single free standing inserts from the output section and positions the inserts for a) insertion where the insert may be aligned edge on for being inserted edge on into a jacket and/or envelope fold, or b) collation where the insert is positioned for face on placement into the raceway.

Operation of the Singulater feed line 48 will now be described in greater detail. Input conveyor 122 may have a surface-conveying drive roller affixed to an input conveyor and transports infeed bundles 120 along the surface of input conveyors. The surface conveyor may include a mattop convey or other such apparatus and may have a capability to travel at varying speeds, either under automatic or manual control. For example, the surface conveyor may stop and start in a manner that will not cause damage to the bottom FSI. The elevator conveyor 126 has a presence sensor 314, such as a photo eye, mounted at the end of the conveyor to detect an FSI bundle that reaches the elevator belt bundle lift point where horizontal conveyor 122 stops delivering FSI bundles and goes into a FSI Bundle Queuing and Indexing mode of operation. Queuing and indexing of FSI bundles accomplishes the stopping and starting of conveyors, for example by soft motor starts and stops, so that the FSI bundles do not fall or have the bottom paper damaged. The Elevator Conveyors 126 may lift the stack of FSIs to a merge point with the Elevator Bayonets 130. As will be described below in greater detail, both A and B FSI stacks may be merged with the combination of elevator conveyor 126 and elevator bayonets 130 being independently positionable. Elevator conveyor 126 accepts loading of untied bulk FSI bundles based on demand where the bundles are fed manually or automatically onto the horizontal input conveyor 122 from pallets or bins 36.

In one embodiment, the horizontal conveyor 122 may include an apparatus for selection between manual and automatic operation. Before a final infeed bundle in a run of FSI is placed for input, a data sheet 133 for the next set of FSI may be placed face on top of the bundle being loaded by the person or machine loading the bundle onto the conveyor. The data sheet 133 may contain information about the next run of FSI that is to occur at the location of this equipment. The data sheet 133 may have a bar code, imbedded RF tags, or other identifying information such that data can be electronically read by equipment such as omni-directional bar code scanners vision systems, or RF tag readers 135, with the data transferred to the controller 140 for confirmation with the master system controller 67. The bar code or RF tag data will be used by the local controls to invoke a startup sequence for the local controller 140. After the data sheet 133 is read and the information is confirmed for accuracy with the host control system 67, via a wireless connection or otherwise, the data sheet may be sent to the reject gate 168. If a problem occurs on device 48 during the run and the FSI material is moved to another location, the data sheet may transfer with the FSI material. Here, the problematic Singulater feed line that was running the original FSI materials may be taken out of service or loaded with a different material. The master control system 67 will track movement of material, run and historical data and provide updated scheduling information upon request. A bar code reader 135 may be positioned above the maximum bundle height for the purpose of reading a bar code on the data sheet of the next FSIs to run on the Singulater.

The elevator conveyor assemblies 132 may be adjustable for wide FSIs or narrow FSIs. For example, for wide FSIs, more Elevator Belt sections may be added by a plug-in unit. The elevator includes a set of elevator conveyors 200 that operate independently of each other. The set of elevator conveyors 200 may operate at different speeds than the input horizontal conveyor to ensure that the bundles are properly separated. The Elevator Conveyors are located under and on either side of the FSI bundles as they enter the elevator 132. The elevator conveyors 126 transfer the stack of FSI from the input horizontal conveyors 122 into the loading position—against the back portion of the housing of the elevator 132, as illustrated by the position of bundle B. If the elevator is empty at the time of entry of a bundle into the elevator conveyor 126, the elevator bayonets 130 may pick up the bundle of FSI (for example bundle a initially loaded on conveyors 126) from the elevator conveyors 126 and transport to singulater 134 as shown by bundle A in FIG. 4. Here, the elevator bayonets 130 may go to a load position all the way down and fully extend (as will be described below). When fully extended, the bayonets are positioned between the individual elevator conveyors 200 (see also FIG. 10C). The elevator conveyor 126 and elevator bayonet 130 may independently lift FSI Stacks A and B. The elevator bayonets 130 may be instructed by controller 140 to go to a bayonet transfer Point (BTP) and be fully extended between the Elevator Conveyors to transfer an FSI bundle to or from the elevator conveyer. for example, the elevator conveyor 126 may lift replenishment bundle B to the singulation device 134, hand off the replenishment bundle B to the elevator bayonets 130 while continuously singulating bundles, and subsequently return to receive another bundle C while the elevator bayonets continue to feed the singulation device 134 as shown. In this manner, the singulation device 134 may be substantially continuously fed with FSI as both the elevator conveyor 126 and elevator bayonets 130 may be operable together or independently. As may be realized, the bayonets 130 extend below the (e.g. bundle A) and take over the function of lifting the stack to the singulater 134 (in the case where bundle A has been lifted initially by the elevator conveyors 126). After transfer of the bundle to the bayonets, the elevator conveyors 126 may return to the FSI load bundle position allowing, for example, bundle C to be loaded thereon (to the position of bundle B). When the next bundle (e.g. bundle B) of FSI reaches the elevator load position, the elevator conveyors 126 may lift the bundle until the top of the bundle abuts the bottom of the preceding stack, illustrated as bundle A in FIG. 4, currently held by the elevator bayonets 130. The bayonets may retract where the top of the FSI stack B may then be lifted to the bottom of stack A where the gap between bundles A and B is eliminated. The bayonets have small pressure sensing devices 137 located on the bottom side of the bayonets. As the bundle on the conveyor elevator 126 presence is detected by the pressure sensors, a signal is sent to controller 140 and the bayonets retracted. The elevator conveyors 126 may now lift FSI combined Stack A and B together and continue singulation as will be described below. The elevator bayonets may then go to the Bayonet Transfer Point (BTP) where the points of the bayonets nearest to the elevator conveyors may be positioned in between the elevator conveyors and tracking the vertical position of the elevator conveyors 126 as singulation is maintained. The bayonets may then extend and be lifted to contact Stack B for transfer of an FSI bundle to the Singulater by the bayonet conveyors 130 instead of the elevator conveyors 126. The elevator conveyors 126 may then again return to the FSI load bundle position (see FIG. 4) to accept, for example, next bundle C, repeating the cycle. In this manner, the singulation device may be substantially constantly fed with FSI as both the elevator conveyor 126 and elevator bayonets 130 may be operable together or independently.

The controller 140 determines thickness of each sheet as reported by a sheet detector 162. The elevator bayonets 130 may lift and lower in unison or independently from the elevator conveyors 126. To remove FSI from a stack, as the top of a lift is achieved, the top FSI is extracted by the Singulater 134 and the elevator (bayonets or conveyors or both depending on the transfer state of the feed stack) then moves in the opposite direction less the thickness of the FSI that was extracted. As may be realized, this produces a cycling process that is repeated over and over until all of a FSI is consumed. Each elevator may have two independently controllable lifts 128, 129 and 300, 301 to allow leveling of an FSI bundle at the Singulater 134. As will be described below, two detectors 302, 304 sense the location of the top of the stack at the singulater to allow leveling of the stack by the independent lifts relative to the singulater. As the Singulater pays off FSI, the elevator ensures a bundle is in position for reliable singulation. The FSI proper position at this location may, for example, be determined via the use of ultrasonic sensors. A condition may occur upon the expiration of the final FSI stack if the elevator bayonets 130 are not capable of reaching the singulater 134. For example, the elevator conveyors 126 may ascend and complete the delivery of the final section of the FSI stack to the singulater 134. As the singulater 134 pays off product, the elevator conveyor 126 will deplete the final stack to end the cycle. The FSIs proper position at this location may be determined via the use of ultrasonic sensors or other forms of analog detection devices. The singulation apparatus 134, as will be described below, has a singulation wheel with vacuum-controlled suction cups. Controller 140 may control rotational speed and position to accurately extract single sheets from the potentially endless supply of FSI stacks or extraction demand. Here, the Singulater apparatus 134 separates individual sheets from FSI bundles and delivers them to a target destination or, for example, to a metering conveyor 137 that meters the conveyance of the FSI to their targeted destination. The Singulater 134 may be a servo-driven vacuum device comprising a rotationally disposed drum and vacuum source connected to drum. Vacuum is continuously supplied to suction cups located on the bottom rollers of the Singulater via the use of a pneumatic manifold. A current of air may be directed by low pressure air values acting as air jets at the top of the infeed bundle(s) to help in the separation and/or singulation stage. Vacuum applied to the Singulater is provided to suckers affixed to the drum of the Singulater that are making contact with the FSI. Here, suction provided to the suction cups lifts the top sheet off of a FSI bundle, which sheet is transported to an output conveyor 138. The singulater may turn rotationally at a rate that provides singulated output to the output conveyor. The ability to get just the top sheet off of the stack is accomplished by spinning the Singulater, either continuously or in increments, such as, for example, about a 270 degree increment that may be dependent on the known size of the FSI (programmed in controller 140).

The elevator 132 lift motors are directed to lift the stack up to the bottom set of suckers on the Singulater 134 where the lifting actions may remain in place for a predetermined amount of time that may be calculated by the controller. For example, the time in place at the top of the lift may be dependent on the thickness of the FSI, that may be programmed into the controller, and used in a control protocol (e.g. table or algorithm) to determine the time in place. The elevators may then return to their original or a lowered location less the thickness of the FSI being disposed with this up and down action in combination with Singulater rotation being controlled by controller 140. As may be realized, in alternate embodiments the cyclic motion between singulater and top of stack may be generated at least in part by motion of the singulater itself. The speed of the Singulater 134 may be determined by the demand for product, for example, at the metering conveyor 137. The Singulater is supplied with vacuum for taking a single sheet from the top of the bundle of FSI to a control stream of single sheets, for example, on the metering conveyor 137. As will be described below, sensors are provided prior to the metering conveyor for the purpose of detecting a missed feed. For example, the Singulater may turn about 60 degrees (or other desired amount) and if an FSI is not detected by the sensor, then a retry is initiated and the speed of the Singulater and the metering conveyor are adjusted for the difference. Difficult to dispense FSIs may require the following actions. The Singulater stops turning with the suckers at the 6:00 o'clock position, with vacuum being applied to the suckers. The stack of FSIs is lifted to the suckers. The stack is lowered away from the sucker less the thickness of one FSI. In this case, the direction of the Singulater may be initially reversed (e.g. rotated clockwise or opposite to the counter-clockwise feed direction shown in FIG. 4) for about 20 encoder degrees. Subsequently the Singulater to its feed direction (e.g. counterclockwise in the embodiment shown in FIG. 4) and speed. A sheet or multi-sheet FSI 136 meeting proper attributes is conveyed by the rotation of the Singulater drum in the direction of the metering conveyor 137 that operates at various speed. The metering conveyor may have, for example a vacuum conveyor, and conveys the FSI to a staging conveyor 139. The staging conveyor may for example have a vacuum belt conveyor. The operating speed of the metering conveyor may be determined based on speed of the staging conveyor 139. Rejection, for example, of mis-feeds or double-feed sheets, and controlled ejection schemes may be accomplished by a detection and ejection scheme. The metering conveyor 137 that receives FSI ejected by the singulation wheel may incorporate a thickness sensor 162 and a rejection hopper 143 that cooperatively remove unwanted (misfed) FSI, or alternatively, provide a desired insertion scheme according to user selection. The rejection hopper 143 follows the metering conveyor 137 to remove unwanted insertions or to redirect a portion of the FSI. The metering conveyor 137 may comprise a servo-driven vacuum conveyor. The measuring device 162 may be a laser-based thickness measuring device located just above the vacuum belt at the metering conveyor 137, sensing the presence and thickness of the singulated piece 136 exiting from the singulater 134. The laser may have a floating target attached to the laser that rides on the conveyor. Though the target is free to float along the laser beam, the target is otherwise fixed so that the beam illuminates substantially the same point on the target. Hence, as an FSI 136 passes under the laser it may pass between the target and conveyor thereby moving the target closer to the laser. The amount of movement is measured by the laser and an averaging program is started in the controller that keeps track of the FSI thickness. For example, the first three FSI sheets may be used to obtain automatic-learn information about the FSI and stored for use where FSIs with the same characteristics may use the same operational information. The number of sheets used to determine the average may be adjustable. Additionally, the sheet detector 162 may also learn certain attributes of FSI, such as thickness for current and future FSI setups. The metering conveyor 137 moves single FSI away from the singulater 134 and keeps FSI flat on the conveyor for detection and thickness measurements. The speed of the metering section conveying section 137 may be determined, for example, by the demand for FSI at Staging Conveyor #1 139 and the presence of a good FSI. Hence, the Singulater separates FSI bundles into individual FSI. The individual FSI are then measured by a sheet detection apparatus 162 comprising detection circuits for compliance with predetermined FSI attributes and conveyed by the metering conveyor to the staging conveyor(s). The sensing apparatus 162 may also determine other attributes, such as presence or length of sheets. Once a learning operation has been completed for thickness and length, the system will start to operate at speeds desired to provide a desired operating singulation singulation rate (i.e. plate at which proper individual FSI are serrated from the feed bundle). FSI may be rejected that do not meet the criteria established during the learning cycle. The reject gate 168 may also be controlled by controller 140. Here, those FSI that do not meet the requirements are rejected by a dual gate opening to allow for faster reject rates. Rejected FSI may be returned either manually or automatically to the horizontal conveyor area 122 for reuse. The staging conveyor may be a vacuum belt conveyor that operates at a variable speed. For example, the staging conveyor #1 139 may buffer FSI for availability to staging conveyor #2 141. The buffer function allows single sheets as well as multiple sheets to be stored. The staging conveyor may be partially loaded at start up. When staging conveyor #2 141 needs FSI, staging conveyor #1 139 is used to supply this at a speed determined by the output of the staging conveyor #2 141. For example, an FSI at staging conveyor #1 139 waits until staging conveyor #1 139 receives a feed command from staging conveyor #2 141. Once FSI is in place on staging conveyor #2 141 it is ready for transfer to a loading section 169 (if needed), a gatherer, or an inserter. Here, staging conveyor #2 141 buffers the supply of FSI for equipment such an induction feed tray, insert machine, or a collator.

The control system 140 has a computer, a high-speed wireless connection to man/machine interface, an on-board historical database and self diagnostic functionality. The dedicated controller may contain all the parameters and algorithms desired to run the machine and for interfacing with the machine's sensors, actuators and supervisory system. The high-speed wireless data communication interface maintains the information flow between the controller and the supervisory controls. The on-board historical database records all error conditions, machine performance and all other pertinent historical data. The diagnostic functionality monitors functionality of the system and aids in fault detection and diagnostics. Controller 140 generally may monitor and track or control sensor states, motor positions, discrete positioner locations, transfer and transport rates as well as other relevant data. For example, based on the total distance that each elevator can travel, top to bottom, and the thickness of each FSI, the master controller may calculate the distance of travel for each elevator. As an example, an FSI may have the thickness of fifty stepper counts as measured by a laser sheet detector. The master controller determines the distance that the stepper motors must increment for each FSI and when to return elevators to their home or load position for replenishment. The master control may interface with a computer on an industrial wireless Ethernet network. Machine Man Interfaces (MMI) may reside on a laptop computers or PDAs enabling an operator to perform various diagnostics on the singulation station via the MMI. Manual and automatic modes of operation may be enabled for selection, for example, by the MMI. Running information may be displayed for viewing by the operator, for example product status currently running on the Singulater as well as product scheduled to run in addition to historical data. In manual mode, the operator can perform service operations, such as starting and stopping or adjust the speed of the horizontal input conveyor for example. Different levels of access may be provided, for example to enable more experienced operators or service technicians to change various settings, for example stepper counts and FSI learned thickness. Data, such as for example, product status, configuration settings or changes may be communicated and reported to a supervisory system via an Ethernet link. If a link is not available, the data may be buffered and subsequently reported when an Ethernet link is established. In automatic mode, control for functions such as start/stop or speed adjustment functions will be facilitated by the controller 140. Automatic mode of operation may be selected by the operator via the same operator interface used for the manual operation. Controller 140 may have a servo control panel and may house the servo and stepper control modules, input and output modules as well as the single board computer, safety interlocking devices and interface connection points as well as additional control related modules and components. The controller may support an automatic or a manual mode of operation. Manual mode may include functions such as continuous run, jog function, reverse function, speed adjustments. Automatic Mode may include alarms, drive input from the motors, The servo controllers may have input signals, start—stop functions, run signals, discrete, digital or analog speed or position and reference signals, output signals, discrete faulted signals or otherwise. A light tree may be provided where green indicates automatic mode, yellow indicates manual mode and red indicates faulted mode. Additionally, operator push buttons and switches may be provided. Controller 140 may access and control all potentially automated functions of the apparatus. In alternate embodiments, some of the functions may be manually operated.

Figure 5A:
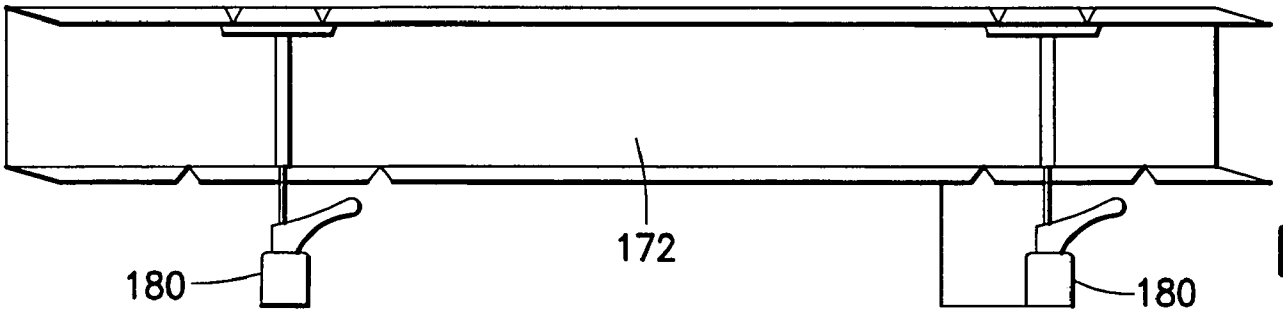
FIG. 5A is an elevation view of a side guide of the Singulater feedline.
Figure 5B:
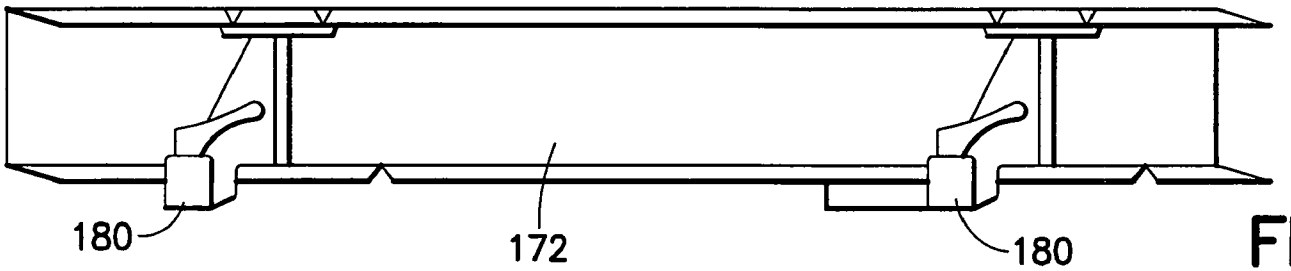
FIG. 5B is another elevation view of the side guide.
Figure 5C:
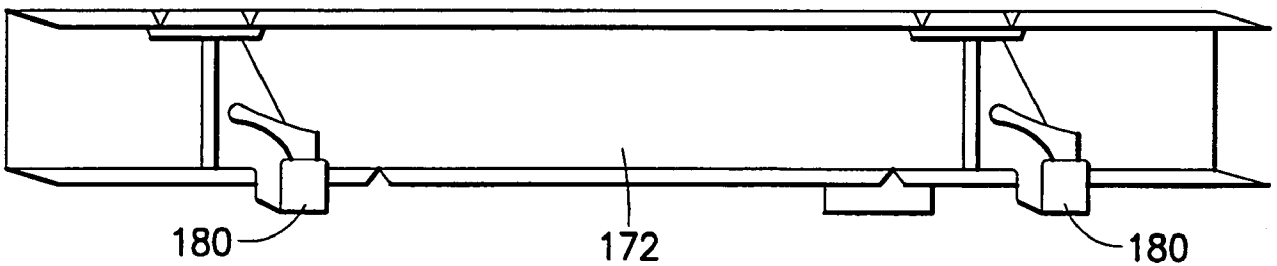
FIG. 5C is still another elevation view of the side guide.
Figure 6C:
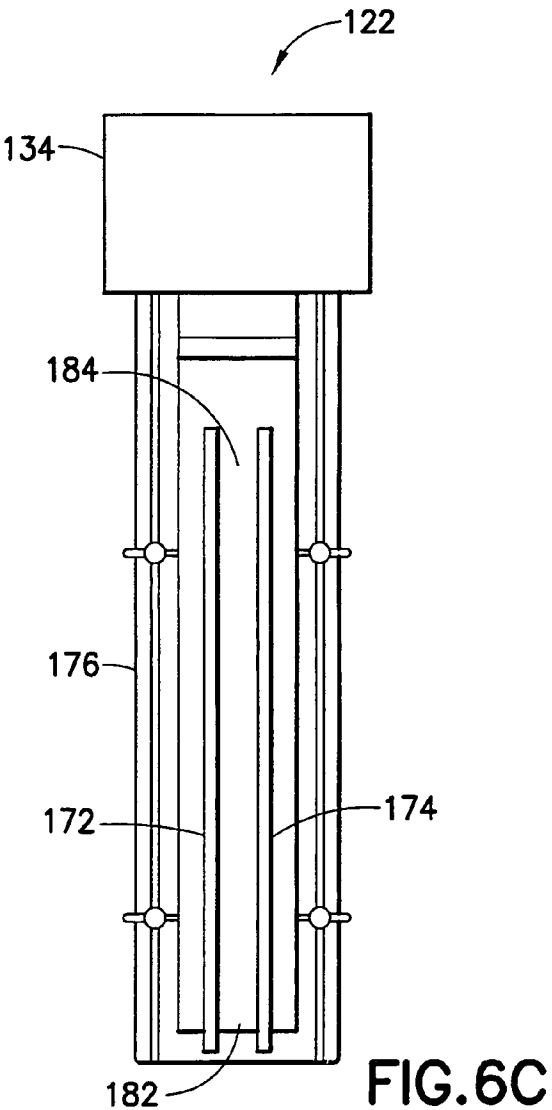
FIG. 6C is still another plan view of the in-feed conveyor showing side guides in yet another position.
Figure 6B:
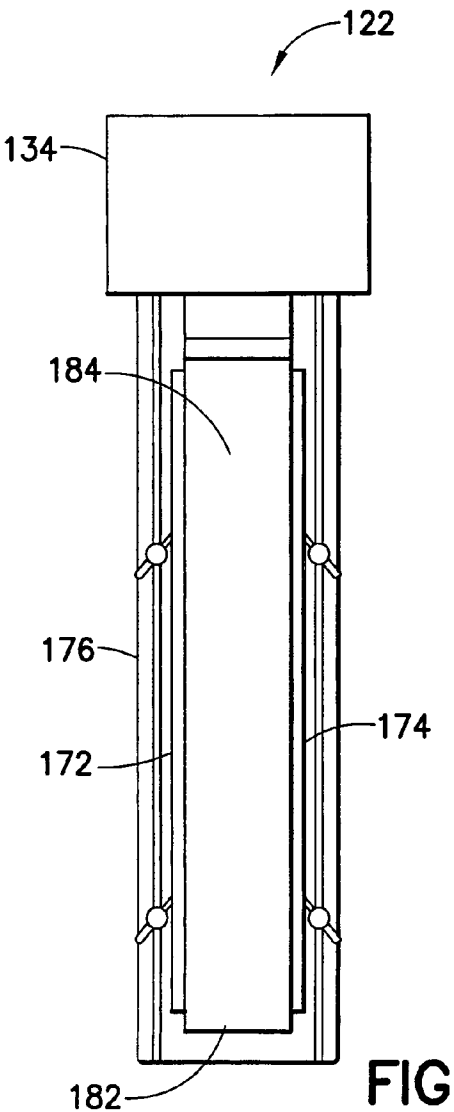
FIG. 6B is another plan view of the in-feed conveyor showing side guides in another position.
Figure 6A:
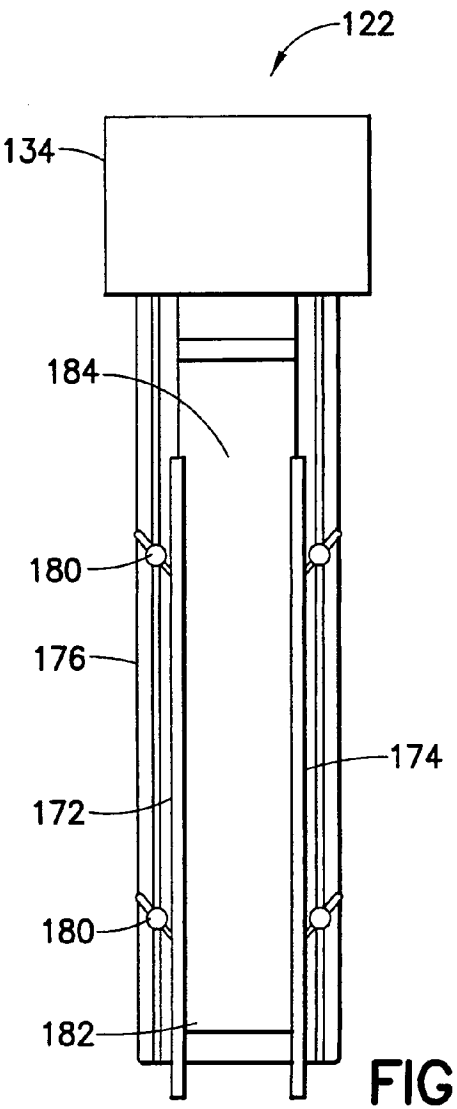
FIG. 6A is a plan view of an in-feed conveyor showing side guides in a first position.

Referring now to FIGS. 5A, 5B and 5C, there are shown elevation views of a side guide 172. Referring also to FIGS. 6A, 6B and 6C, there are shown plan views of an in feed conveyor 122. The in-feed section 122 comprises a horizontal conveyor section 122. The individual FSIs are fed into the singulater from bins 36 (see FIG. 1) in horizontal stacks via conveyor 182 where this section performs the function of a feeder-magazine and enables a single operator to feed FSIs, in any physical orientation, to several singulater lines. The in-feed Section 122 feeds stacks of FSI that may be either compensated and/or uncompensated stacks. The infeed section 122 has a horizontal conveyor 182 and side guides 172 with the side guides having double pivot links 180 that maintain parallelism with the feed path. A sensor 184 is provided on the in feed system 122 for measuring stack height of each module on the infeed section and may be an ultrasonic or other suitable sensor As may be realized, the stack height measurement data is transmitted to controller 140 for determination of lift height of the elevator(s) and the bayonet transfer point.

Figure 7A:
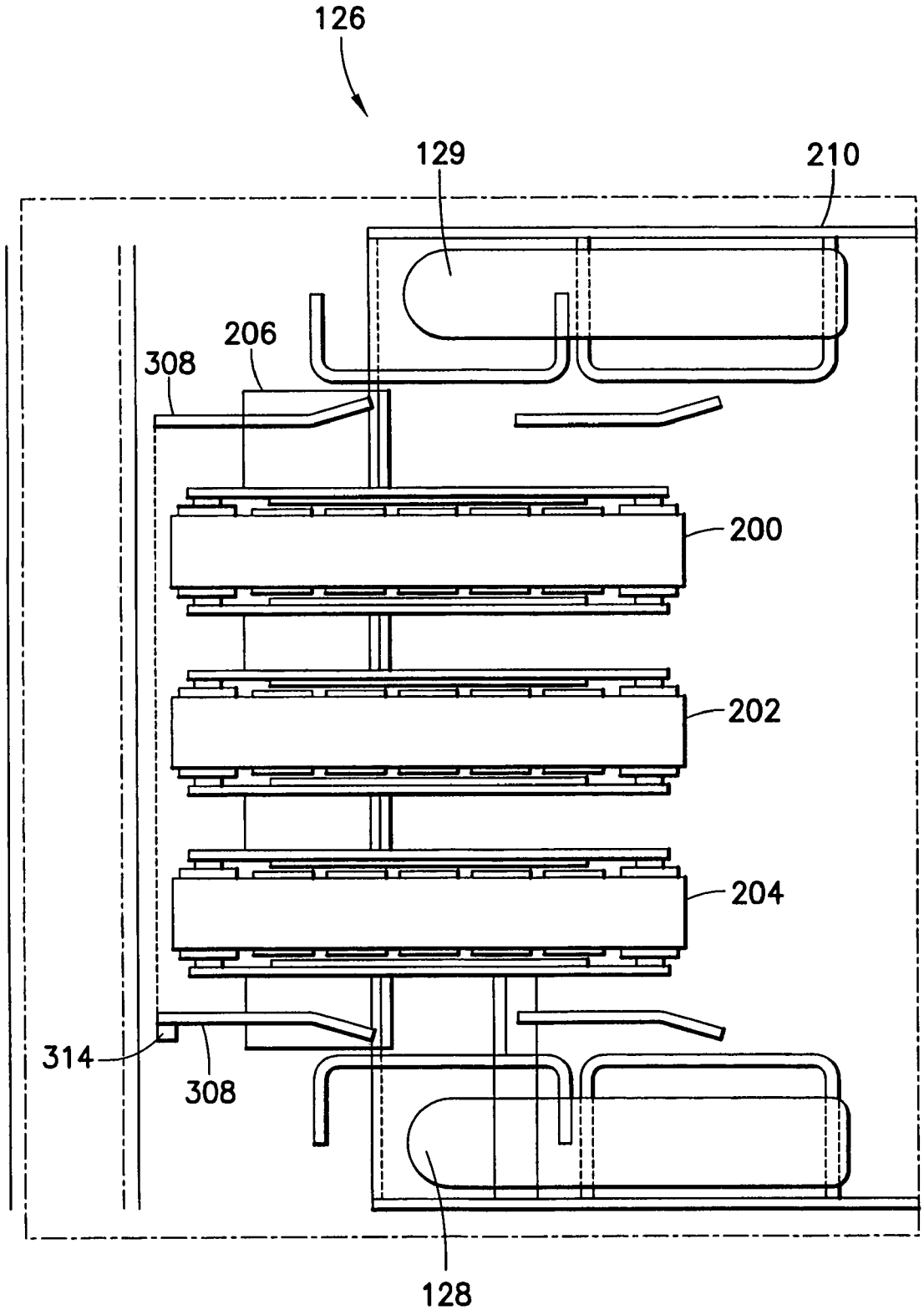
FIG. 7A is a plan view of an elevator conveyor.
Figure 7B:
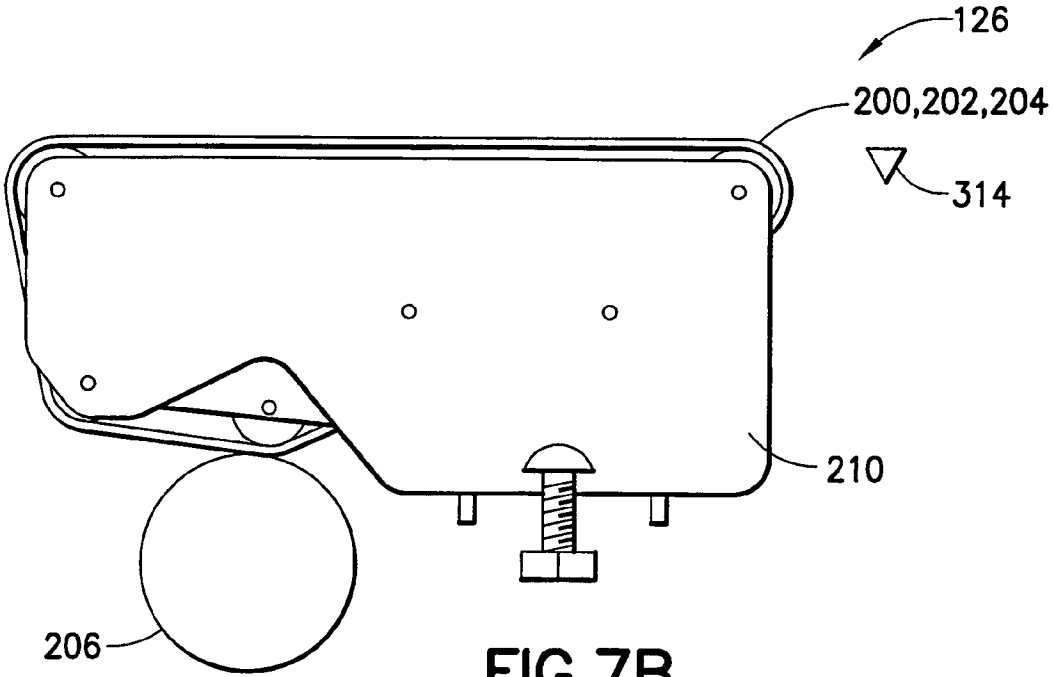
FIG. 7B is an elevation view of the elevator conveyor.
Figure 8:
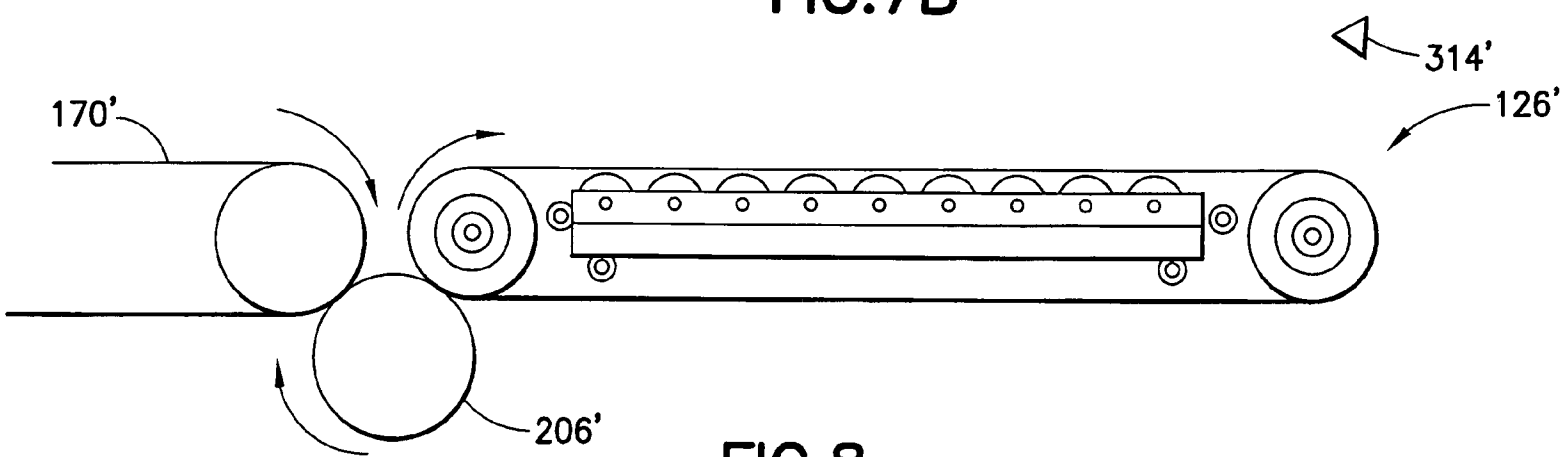
FIG. 8 is an elevation view of another exemplary embodiment of the elevator conveyor.
Figure 9A:
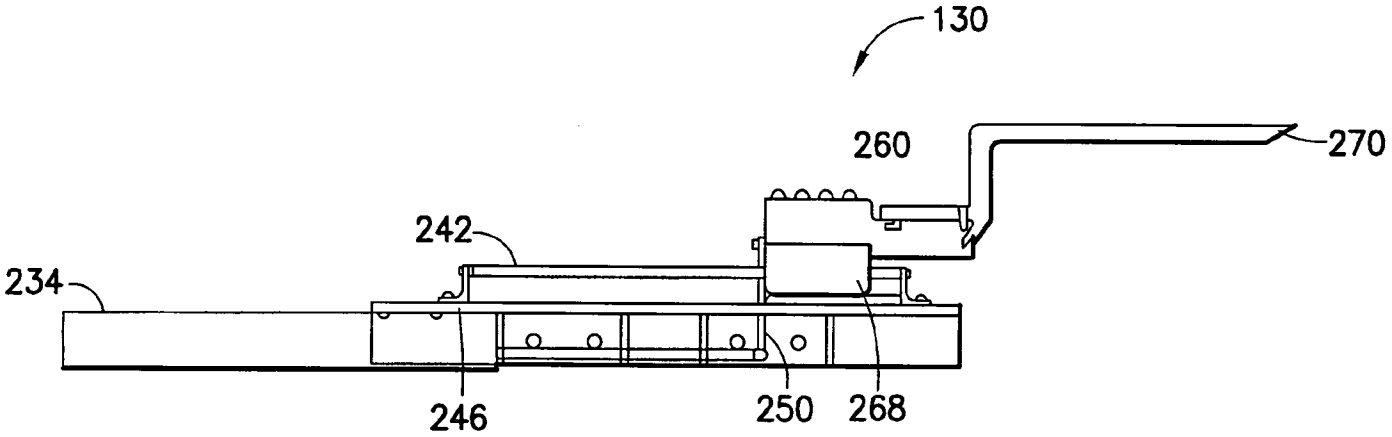
FIG. 9A is an elevation view of an elevator bayonet.
Figure 9B:
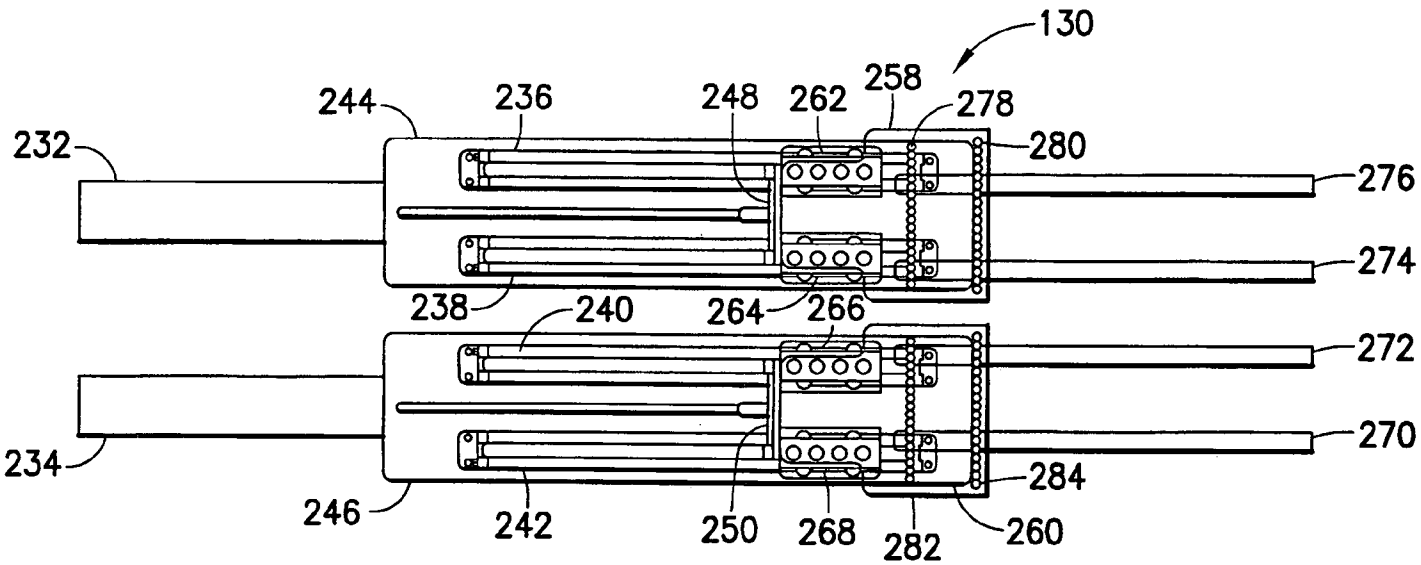
FIG. 9B is a plan view of the elevator bayonet.
Figure 10A:
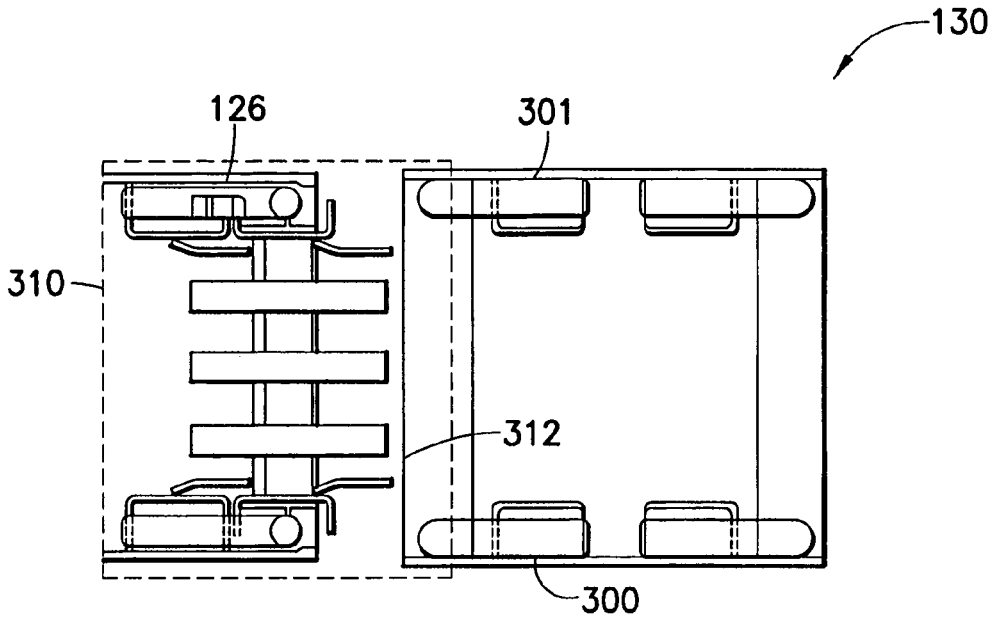
FIG. 10A is a plan view of the elevator conveyor and the elevator bayonet.
Figure 10B:
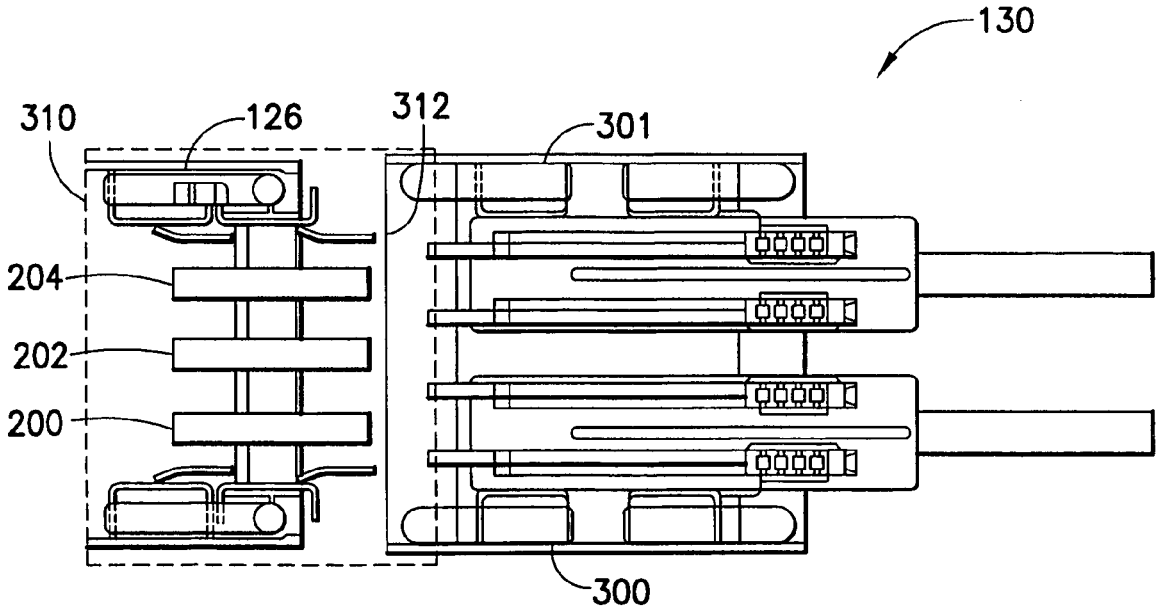
FIG. 10B is another plan view of the elevator conveyor and the elevator bayonet.
Figure 10C:
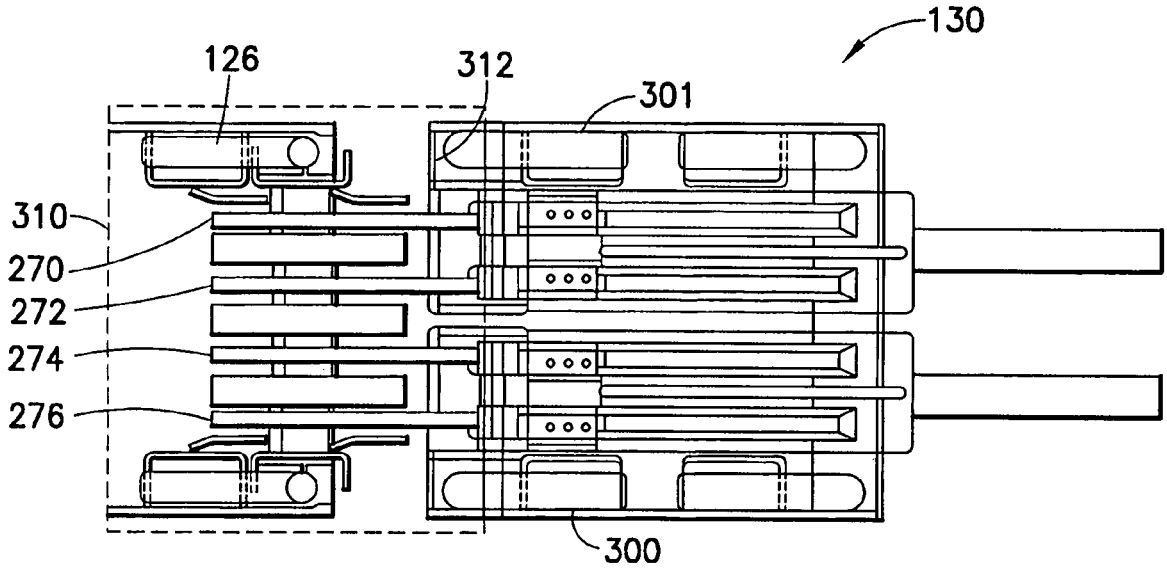
FIG. 10C is still another plan view of the elevator conveyor and the elevator bayonet with the elevator bayonet in another position.

Referring now to FIG. 7A, there is shown a plan view of an elevator conveyor 126. Referring also to FIG. 7B, there is shown an elevation view of an elevator conveyor 126. Referring also to FIG. 8, there is shown an elevation view of the elevator conveyor in accordance with another exemplary embodiment. Referring also to FIG. 9A, there is shown an elevation view of an elevator bayonet 130. Referring also to FIG. 9B, there is shown a plan view of an elevator bayonet 130. Referring also to FIG. 10A, there is shown a plan view of an elevator conveyor 126 and an elevator with the bayonet assembly removed. Referring also to FIG. 10B, there is shown a plan view of an elevator conveyor 126 and an elevator bayonet 130, with the bayonet in a retracted position. Referring also to FIG. 10C, there is shown a plan view of an elevator conveyor 126 and an elevator bayonet 130, with the bayonet in an extended position. The elevator section 132 has conveyor elevators 126 having elevators 128, 129, and further having bayonet elevators 130 having elevators 300, 301. Elevator section 132 in this embodiment has top of stack sensors 302, 304, an air blast section 306 (see also FIGS. 4, 14A) that also acts as a backstop, side guides 308 and back air blast deflectors 310. The tracking of the top of stack will also be aided by the use of the servo encoding system. The encoder will help in position the stack correctly. As noted before, the elevator section 132 supplies a continuous flow of stacked, insertable products or FSI to the singulater 134. This is facilitated, as noted before, via the inter active working of the two conveyor elevators 128, 129 and the two bayonet elevators 300, 301. Top of stack sensors 302, 304 may provide feedback for maintaining leveled stacks at the interface between the elevator section 132 and the singulater section 134. In addition, the top of stack sensors 302, 304 aid in position and control of the location and orientation of the top of stacks 164 of FSI with respect to air ports of the air blast section. Air blasts may be provided to help separate and jog thin FSIs. Entry side guides 308 may be used to properly position the FSIs in the elevator section and guide the stack into the elevator. Rear backstops 312 may be provided to locate the stacks within the elevator. The back air blast deflectors 310 may be used to hold the FSIs in the proper loading position for the singulater 134. The air blasts 306, the side guides 308 and back air blast deflectors 310 used in combination serve to induce an air cushion between FSIs, for example, individual stacked inserts, on the stack of FSI. The elevator conveyor 126 is shown having three conveyor sections 200, 202, 204 for example purposes. In alternate embodiments, any suitable number of sections may be used or alternately a single cartridge can be used. A direct lower drive roller 206 drives the belts either individually or together. Each conveyor 200, 202, 204 may be independently supported and are separated by gaps as shown for admitting lift fingers 270, 272, 274, 276 from the bayonet assembly 130. A load sensor 314 is provided and may be a photo eye or other suitable sensor used to indicate when appropriate to stop the drive roller 206 and enable a lift function.

The lifting drive systems 128, 129, 300, 301 may comprise driven toothed belts and may be independent drives on opposite sides of the conveyor or bayonets allowing for leveling the top of the stack 164 irrespective of if the elevator conveyor 126 or elevator bayonet 130 is holding the stack. In alternate embodiments, any suitable lift may be provided, for example, either as a single axis lift or as two lifts per elevator as described. In the embodiment shown, a single belt is provided on each side of the conveyor frame although any suitable transmission or lifting apparatus may be usable. Stepper motors and/or servo motors may be provided to drive the lifting. The controller 140 monitors position of the top of the stack 164 and maintains top of stack 164 level and in position for effective singulation. Vertical motion may be commanded from a control algorithm factoring target height, offsets, known stack heights, insert thickness or other suitable parameters. The primary feed to the singulater may be by the bayonet assembly 130 where an initial bundle is loaded onto the conveyor 126, transferred to the bayonets 270, 272, 274, 276 to engage the singulation drum 134 with the conveyor 126 and then being used for a replenishment feed of an additional stack. Suitable interlocks may be provided, for example interlocking the bayonet height with the incoming stack height to prevent the stacks from collision prior to feeding a new stack into the elevator conveyor 126. In this instance, the controller 140 compares the bayonet location to the location of top of replenishing stack and waits or raises the loaded bayonets to the appropriate height. In one embodiment, the raise height of the elevator 126 is established to bring the top of a stack into contact with bottom of the bayonets 270, 272, 274, 276 at a suitable time in the bayonet cycle, for example, the bottom position stop. After contact, the elevator conveyors 126 move in conjunction with the bayonets 130 in unison to continue to feed the Singulater and maintain steady state rate and supply of FSI to the singulater section 134. In an alternate embodiment, the raised height of the elevator 126 may bring the top of a replenish stack proximate to but not in contact with bayonets 270, 272, 274, 276. In this case steady state singulation is interrupted, for example where a singulater stopped cycle is extended. Here, a buffer may be provided to compensate for singulation interruption. The bayonets 270, 272, 274, 276 may extend or retract as shown in FIG. 10B and FIG. 10C. As another example, the bayonets 270, 272, 274, 276 may be retracted as shown in FIG. 10B and a replenishment stack engaged with the singulater by the elevator conveyor 126 where the top stack becomes that replenishment stack transferred to the elevator conveyors 126. The retracted bayonets may then be lowered and extended below the replenishment stack on the conveyor 126 and lifted to pick the bottom of the combined stack where both the conveyor lift 126 and the bayonet lift 130 track position to know, for example, the gap. Both lifts 126, 130 in unison may convert to a known oscillation for effective singulation matching connector oscillation for singulation to eliminate, for example, Z gap to pick. The elevator conveyor 126 may then return home for the next replenishment stack while the bayonets 130 feed the Singulater 134. Here, the controller 140 in combination with motor position sensors tracks position to know, for example, the home position. For example, the home position for elevator conveyors 126 being known enables program to look at bayonet height compared to the replenish stack height to effectively start the next replenish sequence. Both the elevator conveyor 126 and the elevator bayonets 130 track position and may have multiple independent lifting mechanisms 128, 129 and 300, 301 to maintain level and location of the stack relative to the Singulater 134.

Top of stack sensors 302, 304 may be provided at different positions, for example on edges of the stack, to detect the top of the stack and out of level of the top of stack. The sensors 302, 304 may be movable mechanical fingers, alternately, any suitable sensor could be used, for example a non contact sensor. The top of stack sensors 302, 304 contact the top of the stack surface on opposite sides of the stack. The finger mounting position may be adjustable. Each sensor may have a frame and a sensor, such as an Linear Variable Differential Transformer (LVDT) LVDT. The sensors provide position feedback to allow the lifts 128, 29 and 300, 301 to locate the stack top relative to a known location of the bottom of the singulation drum 344 of singulater section 134. Initially, the top of the stack location may be set with the top of stack sensor 302, 304 based on preset a distance stored in the controller. For example, the present distance may be a constant upstroke move where the move is the difference between a bottom position and a top feed up position and may typically be the same. The position is then compensated for the sheet thickness of inserts removed by the singulater 134 and may, for example be averaged over cycles. Cycle to cycle deviations may be sensed by the top of stack sensor 302, 304 at the bottom of each cycle. Such deviations may be used as raw data to correct position or averaged over time to compensate for changes. For singulation pick cycles, both an upstroke and a down stroke of the stack may be used. Additionally, an average deviation input may be used in the down strokes to compensate for variance measured by top of stack sensor in prior pre-upstroke measurement, for example, not in real time. As noted before, sheet thickness may be calculated as an initial thickness value input by the user and then subsequently measured by a sensor 162 on metering conveyor or with the top of stack sensors 302, 304. With respect to the elevator bayonets and fingers, in the embodiment shown, four bayonet fingers 270, 272, 274, 276 are provided. Each frame may have one or more bayonets and independent lift Z drives 300, 301 with similar functionality to that of the elevator conveyor. The bayonets may have a common horizontal drive 232, 234 that may be mounted on a common horizontal motion platform or carriage 268. Home position sensors, such as photo sensors may be provided, in alternate embodiments, any suitable sensors may be provided. The bayonets initial feed is accomplished where the controller 140 knows the position of the fingers and the stack height. The stack may be raised to engage the top stack sensor 302, 304 and used with the controller 140 to establish horizontal flat. Variances are corrected in the stack top and an initial level position is established, for example a correct position baseline and down position for the oscillation motion for pick. (As noted before, the bayonets and belt elevator drives have servos with encoders for tracking of the cyclic movement. For the singulater 134 to pick, the lift indexes, based on encoder information tracked by controller 140 to a top position for a desired amount of time or singulation motion to ensure an effective pick by singulation device 134. The lift then returns to the bottom position and then return from bottom is triggered for the next cycle, for example, by a P2 sensor clear signal where the insert is not blocking the P2 sensor (see also FIG. 14A).

Referring also to FIG. 8, there is shown an alternate embodiment conveyor having a drive roller 206' that drives both conveyor 170 and elevator conveyor 126' with elevator conveyor 126 being removed from the drive roller upon lifting in the vertical directions saving an additional conveyor drive. In this alternate embodiment, in feed bundles are transported from the conveying device 170 along elevator conveyors 126 having free-turning belts driven when the elevator conveyors 126 are in the load position. The elevator conveyors have two idler rollers on each end with small support rollers in the middle of the belt where drive is applied to the belts when they sit down on the knurled rollers 206. The knurled roller 206 is made of, for example, a hardened rubber material that presses against the free spinning elevator belt. The elevator conveyors 126' rest on the knurled roller when it is in the bundle load position where the belt elevators 126 are all the way down, with the belts slaved off of the drive 206 from the horizontal conveyor where the bundle is transported into the elevator conveyor section until it breaks the beam of a photo eye 314' indicating to the controller that the FSI bundle is in position to be lifted up to the bayonet conveyors. The lifting of the elevator conveyors 126 removes drive from the knurled roller and prevents damage from occurring to the bottom FSI.

Figure 11:
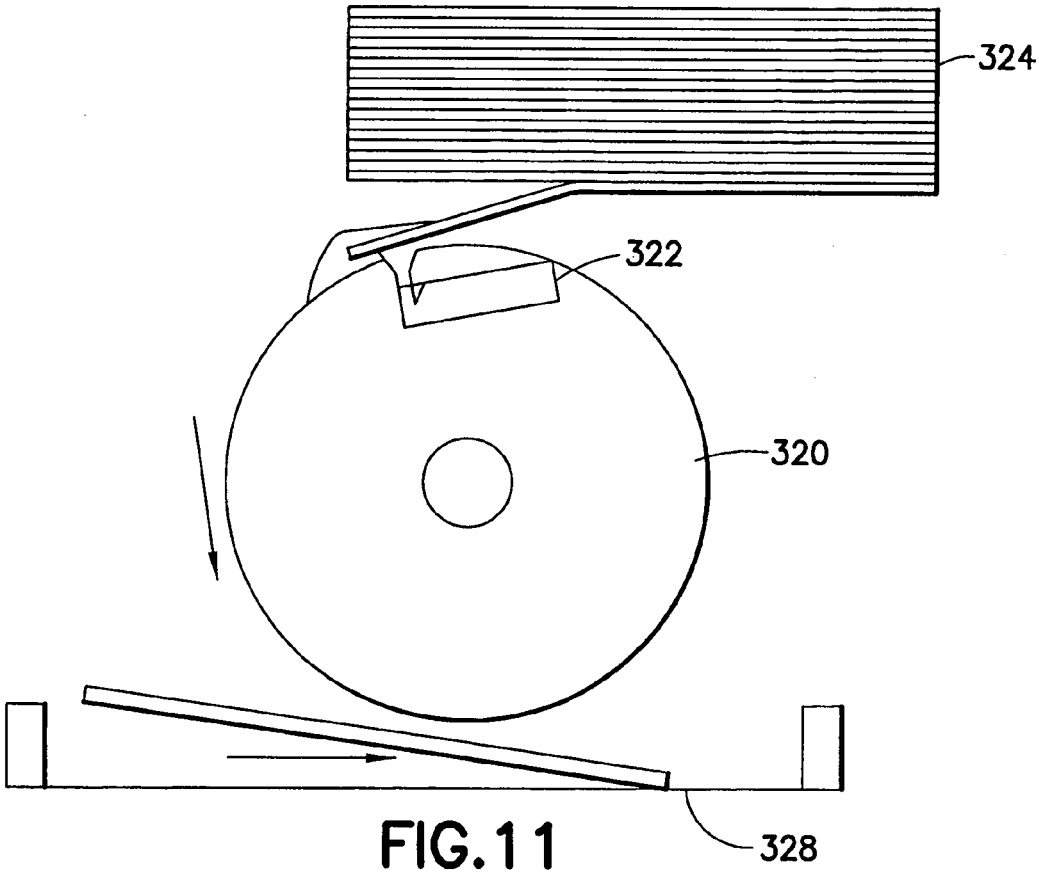
FIG.11 PRIOR ART
FIG. 11 is an elevation view of a prior art Singulater.

Referring now to FIG. 11, there is shown an elevation view of a prior art Singulater having a drum 320, vacuum gripper 322, top feed stack 324 and pushing pin raceway 328. In this prior art device, the feed stack is fed from the top introducing difficulties from factors, such as the weight of the stack. In contrast, the embodiment shown in FIG. 4 employs sheet-feeding at the bottom of the singulation or extraction mechanism and overcomes jamming that often occurs with feed-from-above designs, such as shown in FIG. 11, which subject undue pressure upon the feed mechanism due to the weight of the feed stack. With the embodiment shown in FIG. 4, rather than extracting single sheets from the bottom of feed stack, as performed in conventional designs, a series of servos, stepper motors, and sensor of the present embodiment advantageously enables single-sheet extraction from the top of feed stack. This is accomplished by controlled position of feed stack at or near the bottom of the extraction mechanism.

Figure 12:
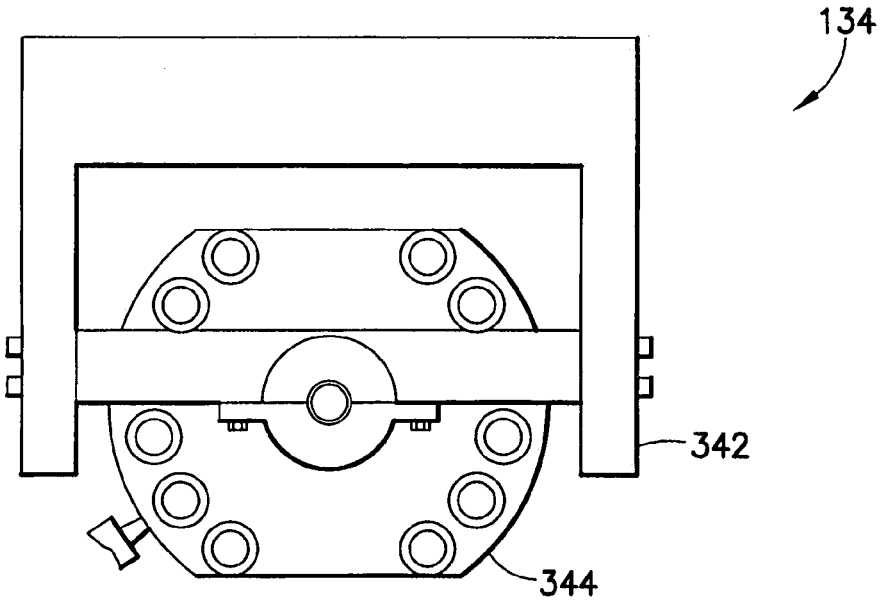
FIG. 12 is an elevation view of an inductor Singulater.
Figure 13:
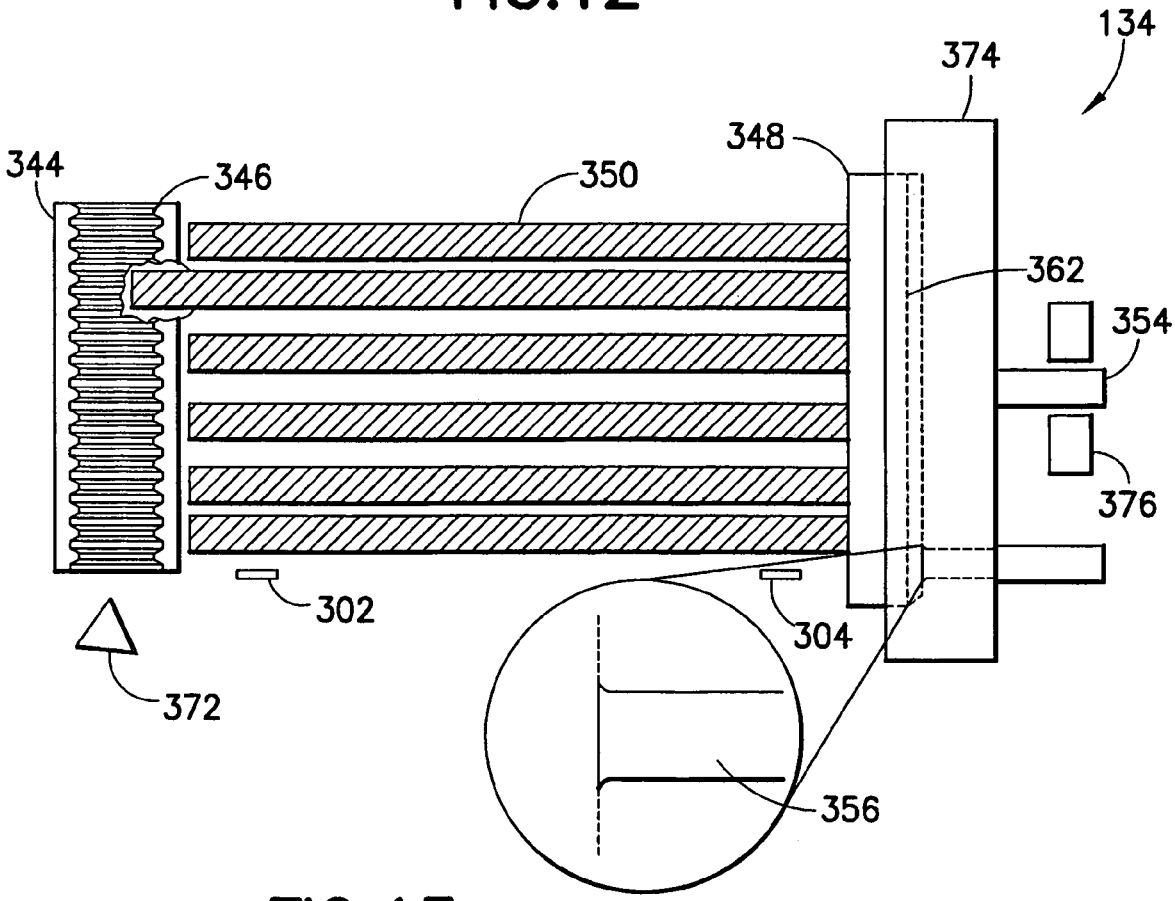
FIG. 13 is another elevation view of the inductor singulater.
Figure 14A:
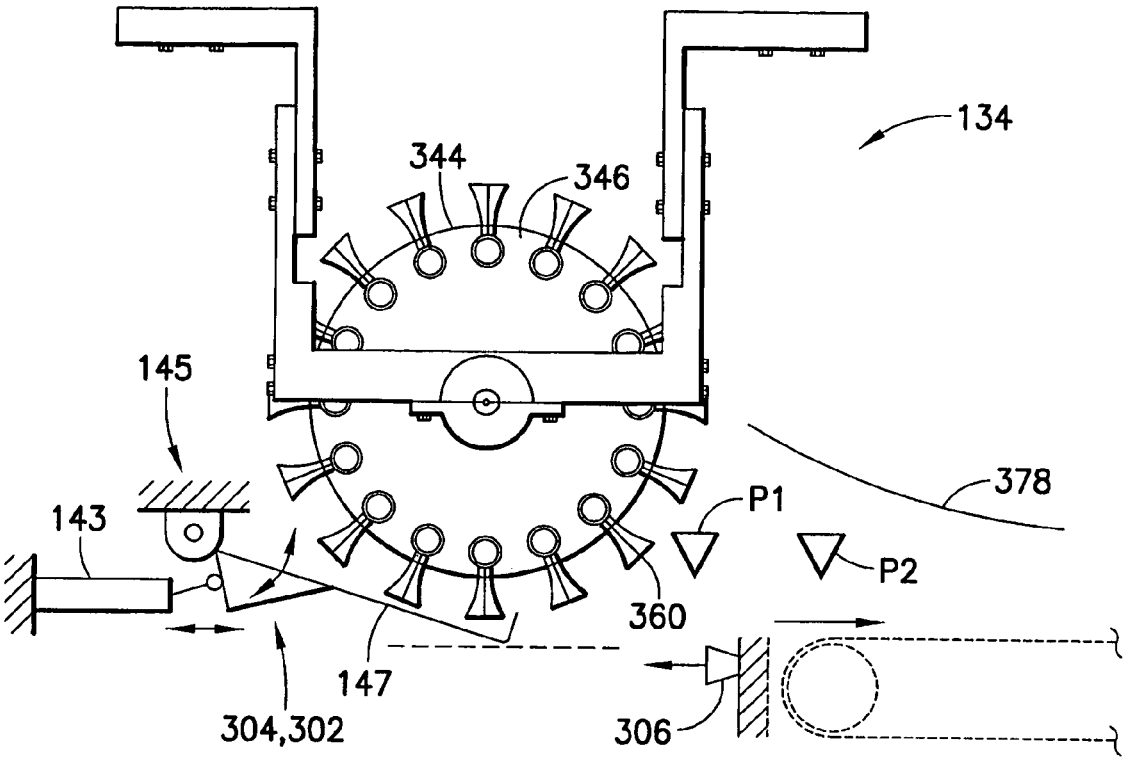
FIG. 14A is an elevation view of a Singulater and insert sensors.
Figure 14B:
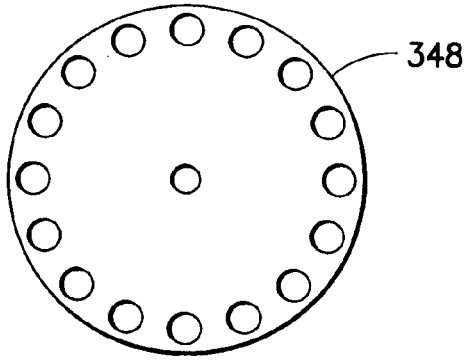
FIG. 14B is an elevation view of the Singulater.
Figure 14C:
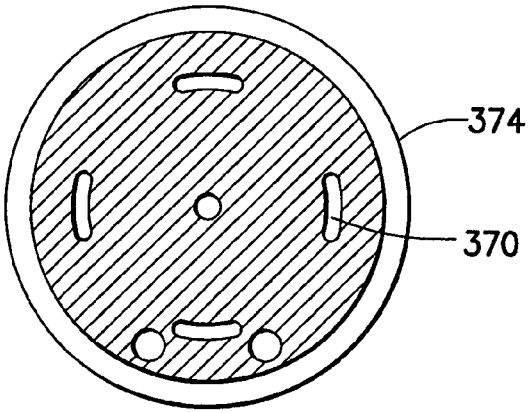
FIG. 14C is another elevation view of the Singulater.
Figure 14D:
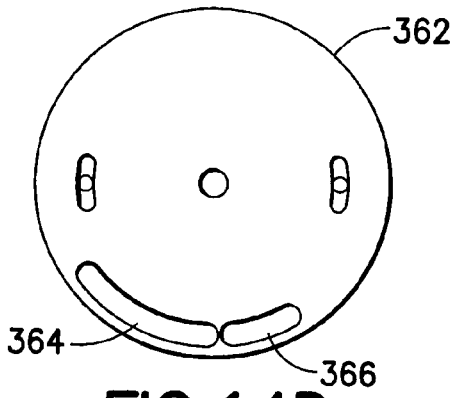
FIG. 14D is yet another elevation view of the Singulater.

Referring now to FIG. 12, there is shown an elevation view of a singulater 134. Referring also to FIG. 13, there is shown an elevation view of a singulater 134. Referring also to FIG. 14A, there is shown an elevation view of a singulater 134. Referring also to FIGS. 14B, 14C and 14D, there are shown section views of a singulater 134. The singulation device 134 is a top feed vacuum device, that is, the inserts are fed from the top of the stack as opposed to the bottom of the stack, to capture the topmost free standing inserts from the feed stack and move each insert to the output system. A current of air may be directed by low pressure air values acting as air jets 306 at the top of the in feed bundle(s) to help in the separation and/or singulation stage as well as act as a backstop. In this embodiment, The singulation device 134 employs a position ally fixed continuous loop vacuum singulation apparatus. The singulation action is rotational whereby rotation of the singulation apparatus 134 is interrupted when the feed stack is raised to bring the topmost insert into contact with the vacuum surface of the singulation apparatus 134. The singulation apparatus is capable of singulating inserts from compensated or uncompensated stacks. Uncompensated stacks are where a stack has the folds in the stack facing the feed direction or opposite the feed direction, whereas compensated stacks alternate the fold direction every other insert or by groups of inserts. Alternately, the stack may be otherwise facing or oriented. The output rate of the singulation device may be variable and is not linked and decoupled from the inserter output rate. In this manner, if, for example, the reject rate increases, then the rate of the singulation device 134 may be increased to continuously feed inserts to the raceway. The singulater 134 utilizes vacuum supplied to suction cups 360 that act as suckers on the FSI. The vacuum is supplied through a vacuum supply control manifold 350 to the suckers 360. A vacuum tubes position sensor 372 and an air blast blow off 366 is also provided. The vacuum cups 360 in combination with rotation are used to grab and remove the FSI off the top of the stack. The vacuum cups 360 may have accordion styled walls for compliance and are used to minimize the position accuracy of the stack. The vacuum supply control manifold 362 is used to control the number of vacuum supply cylinders 350 that are evacuated at any given time. Slots 364 in manifold 362 under vacuum may be provided to ensure the appropriate cylinders have vacuum over a given angular range of motion. Additional holes or slots 366 in manifold 362 under pressure may be provided for blow off by pressure or venting of the appropriate cylinders 350 to allow FSI removal. Kidney slots 370 may be provided to allow adjustment of the angular orientation of the manifold 362 relative to end cap 375 for proper pick and place of the FSI off the stack. The drum of the Singulater may be any suitable size. The Singulater may have end caps 344, 348. One dead end cap 344 may be provided for connection for a rotary drive. One live and active end cap 348 may be provided to engage a manifold 362 to supply rotatable vacuum and pressure to the drum and connecting tubes 350. The suckers 360 are mounted to and/or are in communication with the connecting tubes 350 that may be hollow. In the embodiment shown, 15 tubes are provided; in alternate embodiments, any number could be provided. The material for the drum and tubes may be a polymer, such as nylotron; in alternate embodiments, any suitable material(s) could be used. A rotating shaft 354 connects the caps 344, 348 and extends through the drum with the caps 344, 348 fixed to the shaft 354. A manifold housing 374 is provided fixed and houses the manifold 362 and active end cap 348. The manifold 362 may be a single formed plastic sheet and has both suction 364 and positive pressure 366 ports. The suction slot 364 is sized for the desired number of tubes to be evacuated. The positive pressure port 366 is adjacent in rotation direction to section slot to feed positive pressure to strip insert. The manifold 362 is not rotatable and is adjustably mounted to end 374 and has slotted mounting holes allows for retard/advance port positions relative to bottom of drum. The tube end cap 348 is provided fixedly mounted on the shaft 354 in sliding contact with manifold 362. Mounting holes are provided for tubes through end cap and define inlet ports for the tubes. Flag and detection pads 346 are provided for proximity sensor 372 to position tubes relative to a predetermined reference frame. In alternate embodiments, any suitable sensor or sensor sensitivity could be provided. The sensor 372 registers the location of the tubes to identify position, for example, when there is a tube at bottom dead center position. The tubes 350 may be one piece, for example, 1" o.d.; ½" i.d. plastic tubing. Linear ports are provided in the tubes 350 and directed normal to the FSI surface. In alternate embodiments, other orientations could be provided. In the embodiment shown, there are 5 suckers 360 connected to the ports of each tube 350, but in alternate embodiments more or fewer suckers may be used. If desired, ports may be selectively used capping undesired ports. Each port has a suction cup bellows 360 that provides variable height engagement with the top of the stack 164. This provides a small amount of up motion for further clearance between top insert after pick and next following insert. A drive 376, such a servo motor drive may be provided for rotary position control of the singulater drum. In normal operation, the drive may stop rotation of the drum with the tubes at bottom dead center for subsequent picks. The drive allows starts and stops such that continuous rotation is not used between pick cycles.

As seen in FIG. 14A, output sensor P1 is provided to look at output insert edge. The controller counts detection pads 346 for tube position. For example, if the number of targets detected is greater than a predetermined number then an error indicates no output and a command stop is sent to stops singulater without having to complete FSI transfer rotation of drum/or full cycle of the singulation device. Hence, as may be realized the singulater 134 singulation rate is variable and decoupled from raceway or inserter and/or/collator input rate. The singulater 134 may lag behind and subsequently catch up to correct for errors such as misfeeds. This feature is accomplished as the embodiment does not have mechanical or electronic linkage fixed ratio between the inserter and the singulater thereby decoupling singulation from inserting. Output sensors are provided to detect singulated FSI position. A P1 sensor is provided as a photo cell to look at the back stop plane and is located proximate to the drum perimeter. The P1 sensor is triggered by insert output from the Singulater drum. A P1 "on" signal causes continued rotation of drum command and may not enable lowering of top stack sensor fingers. A P1 "no/lack of" signal causes the algorithm to count Singulater targets and compares to predetermined number; if more are detected, then command Retry. A P1 "off" signal (output insert clears sensors) causes Lower top of stack sensor fingers command when P2 "on" signal. A P2 photocell may be provided down stream of P1 (about 2"). A P2 "on" signal in combination with a P1 "off" signal causes lower top of stack sensor fingers command. A P2 "off" signal in combination with a P1 "off" signal causes command upstroke of elevator bayonets and conveyors. P3 and THK measure sensor are provided and described with the metering conveyor. Output deflectors 378 are provided as down facing guides the help guide output insert leading edge down towards the metering conveyor.

Figure 15:
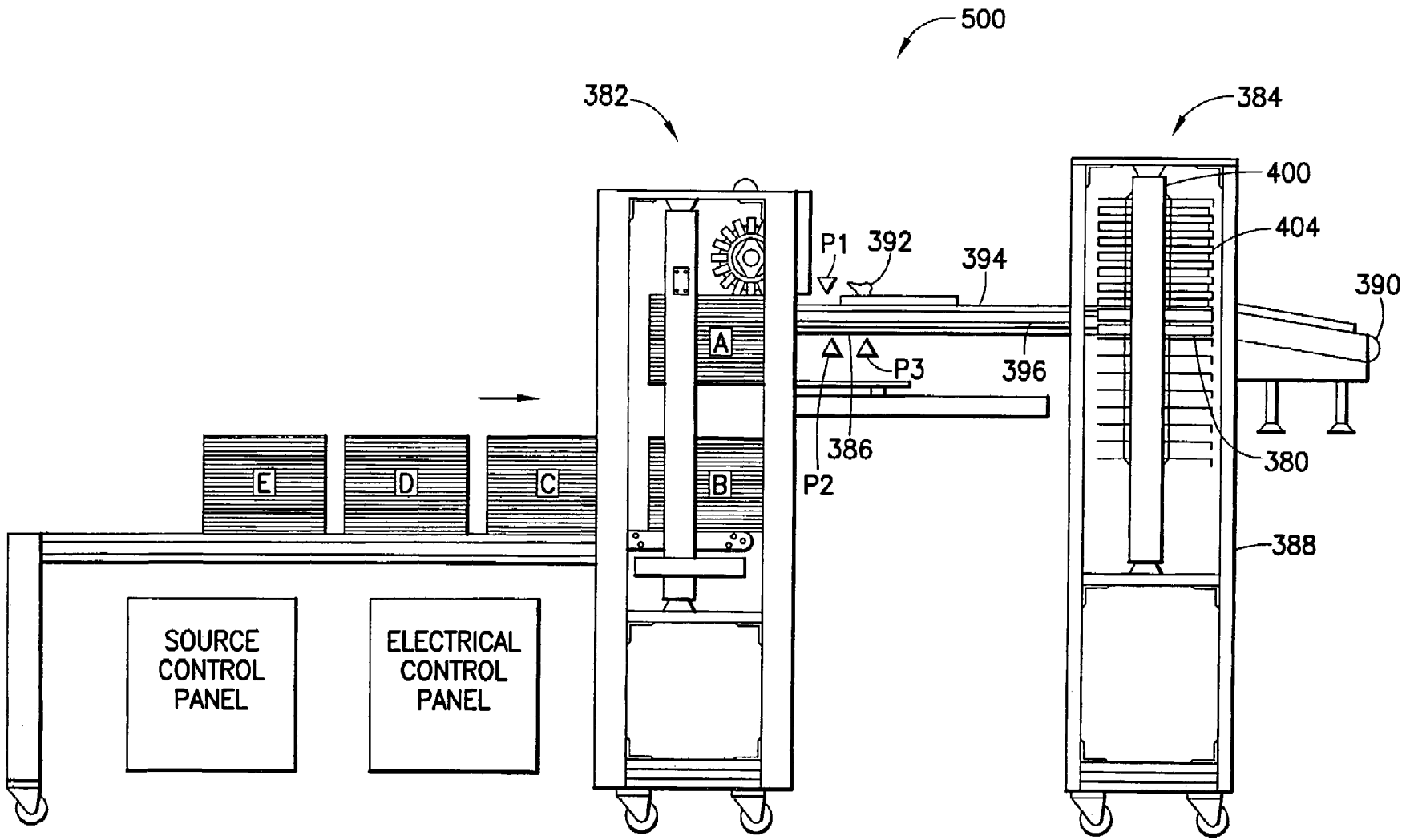
FIG. 15 is an elevation view of an insert feed line in accordance with another exemplary embodiment.

Referring now to FIG. 15, there is shown an elevation view of an alternate embodiment feed line 500 having a buffer section 388. The output system will be described in the context of the alternate embodiment of FIG. 15. The metering conveyor 386 has two section vacuum belts, Laser/Linear Variable Differential Transformer (LVDT) LVDT thickness sensors 392, a sensing area and platform 394 for FSI thickness sensing and two photo electric sensors P1 and P2. The thickness of individual FSIs may be measured with the thickness sensors 392 with the information used to determine if multiple FSIs are feed off the stack simultaneously. Additionally, this information may be used in an algorithm that determines how far to advance the FSI stack after a single FSI is taken off the top of the stack. The photo electric sensors P1, P2 provide inputs to the control algorithm for the feeding of FSIs, as well as the timing for the reading of the FSI stack's position. The metering conveyor is proximate, for example about ½" from the drum with the top surface slightly higher than the top of the backstops. A split belt is provided and separated by centerline ridge rib. A suitable vacuum source is provided where the vacuum removes turbulence, generates laminar flow and draws down the insert to the belt on conveyor 386. A feed speed of the conveyor 386 may be faster than drum rotation of Singulater section 382 to maintain tension. The conveyor speed may be controlled and serves to decouple singulation from insertion rate, for example, the conveyor 386 may be sped up or slowed down to catch up or lag insert to insertion rate. The output insert rides on a ridge where the ridge provides pressure for compaction of the insert to improve measurement thickness and may be used with the opposing shoe. A thickness sensor 392 is provided as a laser or Linear Variable Differential Transformer (LVDT) LVDT or linear potentiometer. For example, if the laser beam is directed against sheet detector member, the laser does not scan the insert surface directly. A P3 photocell is provided and detects presence (block) of insert under the thickness sensor and provides a signal to activate thickness sensor reading. A P3 "on" signal commands a thickness reading by the thickness measurement sensor. The thickness measurement reading may be transmitted to the controller and used to identify conditions, for example, misfeeds, if no misfeeds can then calculate the average thickness of insert. Here, the average thickness of the insert may be used for a sheet thickness in the elevator down stroke motion algorithm where the thickness measurement information may be sent to control for sheet thickness input for down stroke value determination. The initial control algorithm may use a default sheet thickness value for down stroke motion amount. The system may be run at a slow or learn speed until the system has constant and consistent thickness measurement values. The recycling section 396 has a deflection section. When the metering section 386 is detecting multiple FSIs, the recycling section 396 may deflect the FSI away from the normal FSI flow for later to be re-introduction to the singulation process. Here, a trap door at an end of the output of the metering conveyor is provided and actuated and commanded to open upon detection of a misfeed from the thickness measurement sensor. A Chute is provided to direct misfeed inserts to a holder. An optional buffer section 388 may be provided having vacuum conveyor belts 380 and a buffer tray 404. The buffer section 388 provides the ability to buffer and stage singulated FSIs. The vacuum belt 380 propels the FSI to the induction section 390 and the buffer tray 404 stores a multitude of individually stored FSIs. Here multiple trays are indexed on an indexed Z drive 400. The Buffer Section allows single sheets as well as multiple sheets to be stored. The Buffer Section may be partially loaded at start up. The individual trays may be made of a low resistance material that allows the FSIs to pass over it when it is not in the load mode. The elevators may be controlled by controller 140. The buffer interfaces 388 with the inserter to close gaps due to metering conveyor insert output. The induction section 390 may have a cleated vacuum belt or be a modified Singulater. The induction section 390 inserts a single FSI into the raceway or gatherer based on demand from the control system. A conveyor vacuum belt may be used in event of raceway being primary transport. Alternately, a Singulater type drum may be used to move FSI from buffer/metering conveyor into either raceway or inserter. In the event the primary transport is flat raceway less FSI to be input per linear length; in comparison with inserter there are multiple pockets per linear section results in increased output for a given rate of raceway speed.

Figure 16A:
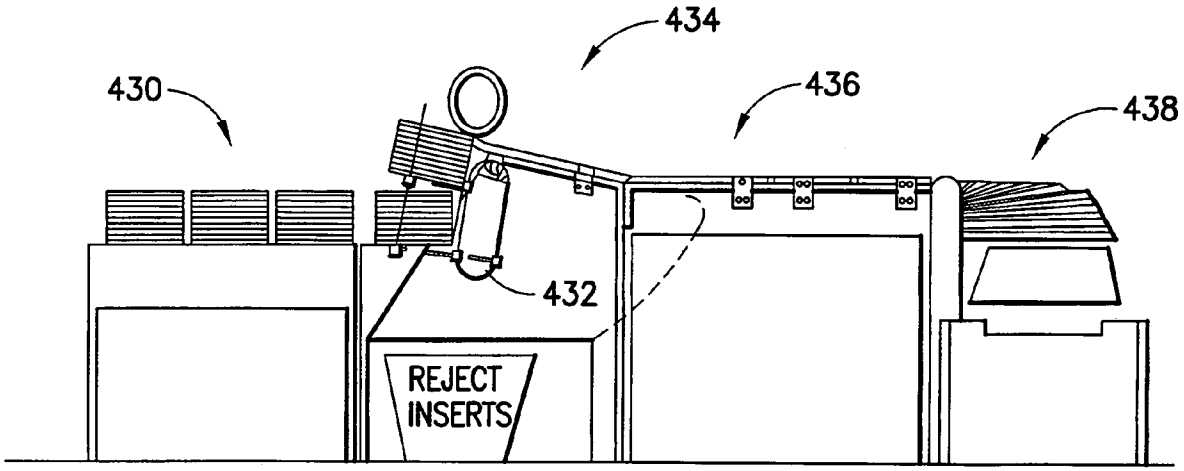
FIG. 16A is an elevation view of an insert feed line in accordance with still another exemplary embodiment.
Figure 16B:
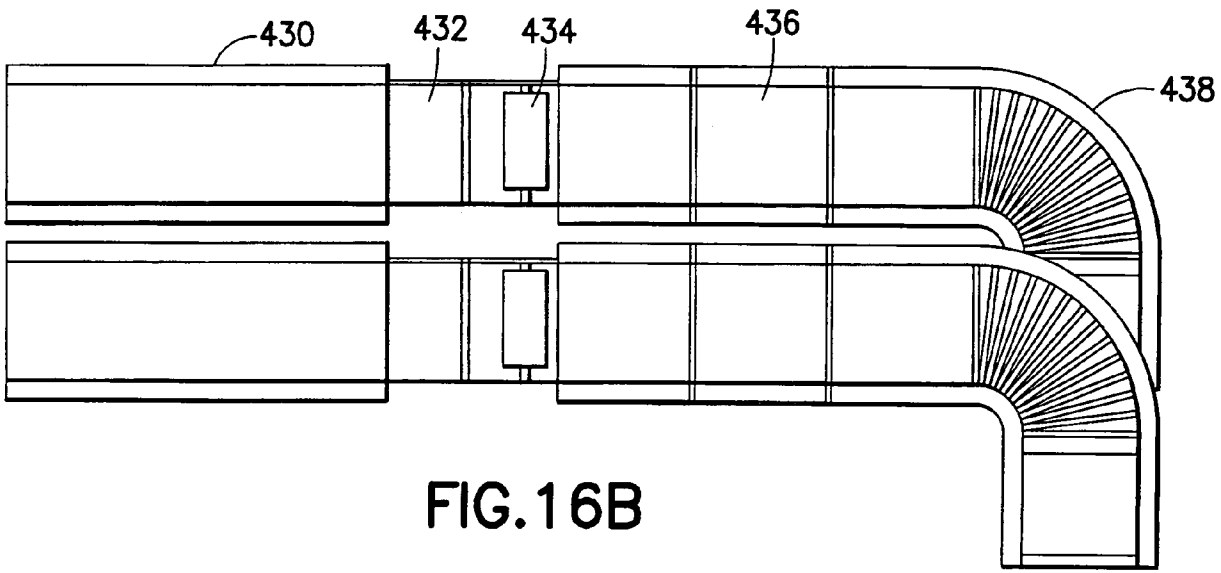
FIG. 16B is a plan view of the feed line in FIG. 16A.

Referring now to FIG. 16A, there is shown an elevation view of an alternate embodiment feed line and raceway. Referring also to FIG. 16B, there is shown a plan view of the alternate embodiment feed line of FIG. 16A. The feed line generally comprises an input system 430, an elevator device 432, a singulation device 434, an output metering and buffering system 436 and an induction system 438. Induction system 438 feeds and inserting or collating raceway and, in the embodiment shown, has a feed direction that is redirected 90 degrees from the feed line feed direction such that FSI's are fed in the direction of the raceway.

Figure 17:
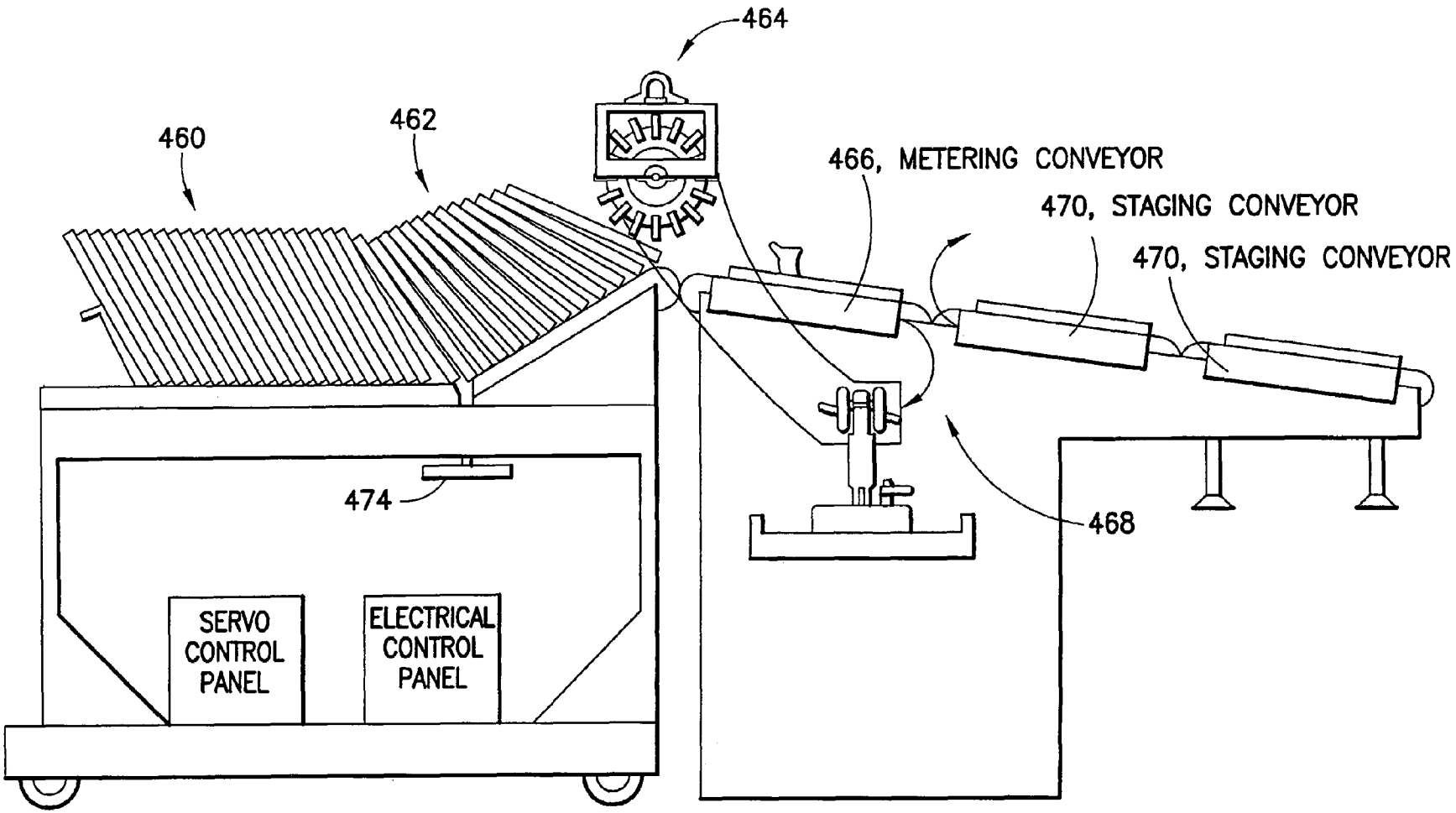
FIG. 17 is an elevation view of an insert feed line in accordance with yet another exemplary embodiment.

Referring now to FIG. 17, there is shown an elevation view of an alternate embodiment feed line having an incline conveyor. The singulation system has a horizontal conveyor 460, incline conveyor 462, singulater 464, metering conveyor 466, reject gate 468, staging conveyor #1 470, staging conveyor #2 472. horizontal conveyor 460 facilitates loading of bulk FSI where by using incline conveyor 462, the FSI may be loaded on to the horizontal conveyor 460 in horizontal log fashion. In contrast, as previously described, in cases where FSI feed elevators are used, the FSI may be fed onto the horizontal conveyor in vertical stacks. In either case, conveyance is demand driven, based on the rate of singulation. The purpose of horizontal conveyor 460 is to ensure continuous supply of FSI to the entry point of incline conveyor 462. Additionally, this conveyor may also be the means with which the FSI angular position is controlled for efficient singulation. Horizontal conveyor 460 may have a manual and automatic mode of operation. In manual mode, the operator may be able to start and stop as well as adjust the speed of the conveyor. In automatic mode, the start/stop as well as speed adjustment functions may be facilitated by the controller. This mode of operation may be selectable by the operator. Incline conveyor 462 continuously supplies Singulater 464 with a stream of FSI. The FSIs proper position at this location may be determined via the use of ultrasonic sensors. Singulater 464 pays off individual inserts from the stack of FSI with the speed of Singulater 464 determined by the demand for FSI at metering conveyor 466. Metering conveyor 466 moves and accelerates the FSI away from Singulater 464 and keeps the FSI flat on the conveyor for detection and thickness measurements. The speed of this conveying section may be determined by the demand for FSI at staging conveyor #1 470 and the presence of a good FSI. A laser based, thickness measuring device may be located on conveyor section 466 that senses the presence and the thickness of the singulated piece. Reject gate 468 deflects pieces that do not meet specification. Rejected FSI may be returned to the horizontal conveyor area for reuse.

Stage Conveyor #1 470 may buffer the supply of FSi, for example, for one of the following, an induction feed tray, insert machine, or collator. In this embodiment, the elevator is replaced by variable speed conveyor 462 where the stacks of FSI's are placed on their side with no gap between the items being conveyed. Here, input conveyor 460 may be an indexing conveyor that moves the stacks of FSI's at a rate determined by incline conveyor 464. A small air plate 474 may be placed between input conveyor 460 and the incline conveyor 464. The purpose of air plate 474 is to keep small items from dropping between the two conveyors and to provide a stream of air, which can aid in the separating individual pages. Incline conveyor 462 may operate at a faster rate than input conveyor 460 to produce a shingled effect on the FSIs/Sigs.

It should be understood that the foregoing description is only illustrative of the invention. Various alternatives and modifications can be devised by those skilled in the art without departing from the invention. For example, those skilled in the art will recognize that the apparatus has other utilities beyond inserts in the newspaper. In other embodiments, sheets other thin paper may be handled. In further embodiments, sheets may be handled for applications in other industries, which, without limitation, may be illustrated by the book and binding industries, as well as postal, photo, bagging industries, and another application, without limitation, may be illustrated in xerographic copying. Accordingly, the present invention is intended to embrace all such alternatives, modifications and variances which fall within the scope of the appended claims.

The invention claimed is:

1. A sheet handling apparatus for collating or inserting inserts, the apparatus comprising:

a raceway adapted to transport sets of inserts at a raceway transport rate; and an insert feed line adapted to feed an individual insert to each of the sets of inserts on the raceway at the raceway transport rate;

the insert feed line having a singulation device adapted to separate the individual insert from bundles of inserts at a separation rate, the singulation device including a lifter lifting at least one insert from the bundles of inserts to separate the individual insert from the bundles of inserts;

wherein, the lifter lifts the at least one insert at the separation rate and the singulation device has a controller adapted to control the singulation device separation rate so that it is variable with respect to a predetermined raceway transport rate, to allow the insert feed line to feed the individual insert to each set of inserts transported on the raceway at the raceway transport rate.

2. The sheet handling apparatus of claim 1, wherein the singulation device comprises a pick disposed to capture the individual insert and separate the individual insert from the bundles of inserts.

3. The sheet handling apparatus of claim 2, wherein the lifter lifts the at least one insert so that the at least one insert contacts the pick, and wherein the lifter cycles for lifting inserts to the pick at the separation rate.

* * * * *